US010524548B2

(12) United States Patent
Park

(10) Patent No.: US 10,524,548 B2
(45) Date of Patent: Jan. 7, 2020

(54) STRAP WITH IMPROVED FASTENING STRUCTURE AND WEARABLE ELECTRONIC DEVICE INCLUDING THE SAME

(71) Applicant: Samsung Electronics Co., Ltd., Gyeonggi-do (KR)

(72) Inventor: Sungeun Park, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 15 days.

(21) Appl. No.: 15/668,302

(22) Filed: Aug. 3, 2017

(65) Prior Publication Data

US 2018/0055159 A1 Mar. 1, 2018

(30) Foreign Application Priority Data

Aug. 30, 2016 (KR) ..... 10-2016-0111019

(51) Int. Cl.
*A44C 5/02* (2006.01)
*A44C 5/00* (2006.01)
(Continued)

(52) U.S. Cl.
CPC ..... *A44C 5/025* (2013.01); *A44C 5/107* (2013.01); *A44C 5/14* (2013.01); *A44C 5/18* (2013.01);
(Continued)

(58) Field of Classification Search
CPC .. A44C 5/14; A44C 5/02; A44C 5/022; A44C 5/025; Y10T 24/4782;
(Continued)

(56) References Cited

U.S. PATENT DOCUMENTS 3,324,649 A 6/1967 Carlson
3,818,552 A * 6/1974 Droz ..... A44C 5/14 24/265 B
(Continued)

FOREIGN PATENT DOCUMENTS

CN 203673260 6/2014
CN 104544797 4/2015
(Continued)

OTHER PUBLICATIONS

International Search Report dated Dec. 13, 2017 issued in counterpart application No. PCT/KR2017/009428, 9 pages.
(Continued)

*Primary Examiner* — Brian D Nash
(74) *Attorney, Agent, or Firm* — The Farrell Law Firm, P.C.

(57) ABSTRACT

Disclosed is a wearable electronic device that includes a strap detachably fastened to at least a part of a housing and including a plurality of unit links, a button operatively exposed from at least one of the plurality of unit links, a tension rib secured to an end portion of the button in an internal space of the unit link and having opposite ends that have positions that are changed by pressing of the button, and a hinge pin secured to each of the opposite ends of the tension rib, and disposed to at least partially protrude from left and right sides of each of the unit links, wherein the plurality of unit links are fastened to or separated from each other, such that the hinge pins of a unit link, moving by means of the pressing of the button, are inserted into or extracted from pin-receiving recesses formed in an adjacent unit link.

20 Claims, 25 Drawing Sheets

(51) Int. Cl.

| | |
|---|---|
| ***A44C 5/18*** | (2006.01) |
| ***A44C 5/10*** | (2006.01) |
| ***A44C 5/14*** | (2006.01) |
| ***G04G 21/08*** | (2010.01) |
| ***G04B 37/14*** | (2006.01) |
| *G04G 21/02* | (2010.01) |

(52) U.S. Cl.
CPC ..... *G04B 37/1486* (2013.01); *G04B 37/1493* (2013.01); *G04G 21/08* (2013.01); *A44C 5/0053* (2013.01); *G04G 21/02* (2013.01)

(58) Field of Classification Search
CPC ..... Y10T 24/3984; Y10T 24/45225; Y10T 24/45251; A44B 11/266
USPC ..... 224/168
See application file for complete search history.

(56) References Cited

U.S. PATENT DOCUMENTS

| | | | | |
|---|---|---|---|---|
| 5,748,571 | A * | 5/1998 | Jackl | A44C 5/02 224/164 |
| 6,014,793 | A | 1/2000 | Howald | |
| 6,163,942 | A * | 12/2000 | Liao | A44B 11/266 24/591.1 |
| 6,406,177 | B1 | 6/2002 | Fukushima et al. | |
| 8,240,011 | B2 * | 8/2012 | Chevrolet | A44C 5/14 24/265 B |
| 9,066,563 | B2 * | 6/2015 | Chan | G04B 37/16 |
| 9,980,539 | B2 * | 5/2018 | Webb | A44C 5/24 |
| 10,182,623 | B2 * | 1/2019 | Perkins | A44C 5/14 |
| 10,184,506 | B2 * | 1/2019 | Chen | F16B 21/12 |
| 2006/0207067 | A1 * | 9/2006 | Maillard | A44C 5/14 24/265 WS |
| 2007/0067967 | A1 * | 3/2007 | Sima | A44C 5/147 24/265 WS |
| 2007/0072721 | A1 | 3/2007 | Takagi et al. | |
| 2010/0306973 | A1 * | 12/2010 | Rinklake | A44B 11/2515 24/593.1 |
| 2011/0014956 | A1 | 1/2011 | Lee et al. | |
| 2013/0145795 | A1 * | 6/2013 | Asami | A44C 5/0053 63/1.13 |
| 2013/0189631 | A1 * | 7/2013 | Mojica | F23Q 1/06 431/274 |
| 2013/0319042 | A1 | 12/2013 | Knuchel | |
| 2014/0101899 | A1 * | 4/2014 | Moille | A44C 5/185 24/265 WS |
| 2014/0283346 | A1 * | 9/2014 | Mitchell, Jr. | A44B 11/16 24/68 E |
| 2015/0107299 | A1 * | 4/2015 | Knuchel | A44C 5/02 63/3.2 |
| 2015/0107300 | A1 | 4/2015 | Chan | |
| 2016/0037876 | A1 | 2/2016 | Perkins et al. | |
| 2016/0037877 | A1 | 2/2016 | Perkins et al. | |
| 2016/0070234 | A1 | 3/2016 | Lee et al. | |
| 2017/0000220 | A1 * | 1/2017 | Moran | A44B 11/26 |
| 2018/0011448 | A1 * | 1/2018 | Von Allmen | G04B 37/18 |
| 2018/0055159 | A1 | 3/2018 | Park | |
| 2018/0157216 | A1 * | 6/2018 | Vuille | A44C 5/02 |

FOREIGN PATENT DOCUMENTS

| | | |
|---|---|---|
| EP | 1 023 851 | 8/2000 |
| EP | 3 479 192 | 5/2019 |
| KR | 200382503 | 4/2005 |
| KR | 100771151 | 10/2007 |
| KR | 200478291 | 9/2015 |
| KR | 1020160058634 | 5/2016 |
| WO | WO 2018/044039 | 3/2018 |

OTHER PUBLICATIONS

European Search Report dated Jun. 21, 2019 issued in counterpart application No. 17846964.9-1017, 8 pages.
Chinese Office Action dated Aug. 5, 2019 issued in counterpart application No. 201710762602.4, 23 pages.

* cited by examiner

STRAP WITH IMPROVED FASTENING STRUCTURE AND WEARABLE ELECTRONIC DEVICE INCLUDING THE SAME

PRIORITY

This application claims priority under 35 U.S.C. § 119(a) to a Korean Patent Application which was filed in the Korean Intellectual Property Office on Aug. 30, 2016 and assigned Serial No. 10-2016-0111019, the contents of which are incorporated herein by reference.

BACKGROUND

1. Field of the Disclosure

The present disclosure relates generally to a wearable device, and more particularly, to the wearable electronic device including a strap having an improved fastening structure.

2. Description of the Related Art

Recently, electronic devices have become increasingly impactful and necessary in everyday lives. Since electronic devices are released in various sizes and shapes according to functionalities and user preferences, external appearances of the electronic devices have also become an important factor, in addition to functionality and slimness of the devices. Users generally prefer an electronic device that has a more appealing design over other electronic devices even if the electronic device may have substantially the same functionality as the other electronic devices.

Since wearable electronic devices are worn on users' bodies, the wearable electronic devices have been restricted in size, but efficiently perform various functions despite the size restriction. However, there is a need in the art for an improved and more attractive and versatile fastening structure for the wearable electronic devices.

SUMMARY

The present disclosure has been made to address at least the above-mentioned problems and/or disadvantages and to provide at least the advantages described below.

Accordingly, an aspect of the present disclosure is to provide wearable electronic device including a strap having an improved fastening structure.

According to an aspect of the present disclosure, the wearable electronic device may include a housing, and a strap detachably fastened to at least a part of the housing, wherein the strap comprises a plurality of unit links, a button exposed from at least one of the plurality of unit links so as to be operable, a tension rib secured to an end portion of the button in an internal space of the unit link and having opposite ends, the positions of the opposite ends being changed by pressing of the button, and a hinge pin secured to each of the opposite ends of the tension rib, and disposed to at least partially protrude from left and right sides of each of the unit links, wherein the plurality of unit links are fastened to or separated from each other, such that the hinge pins of a unit link, moving by means of the pressing of the button, are inserted into or extracted from pin-receiving recesses formed in an adjacent unit link.

According to another aspect of the present disclosure, provided is a wearable electronic device that includes a housing, a strap detachably fastened to at least a part of the housing, and a button assembly embedded in the strap and detachably connecting the strap to the housing, wherein the button assembly comprises a button-receiving body including an internal space, a button exposed from at least a part of the button-receiving body so as to be operable, a tension rib secured to an end portion of the button in the internal space inside the button-receiving body and including opposite ends having positions that are changed by a pressing of the button. and a hinge pin secured to each of the opposite ends of the tension rib, and disposed to at least partially protrude from left and right sides of the button-receiving body, wherein the strap is fastened to or separated from the housing such that the hinge pins, moving by means of the pressing of the button, are inserted into or extracted from pin-receiving recesses formed in the housing.

BRIEF DESCRIPTION OF THE DRAWINGS

The above and other aspects, features, and advantages of the present disclosure will be more apparent from the following detailed description taken in conjunction with the accompanying drawings, in which:

FIGS. 9B and 9C illustrate when the strap according to embodiments of the present disclosure has been coupled to and separated from the housing;

DETAILED DESCRIPTION

Figure 1:
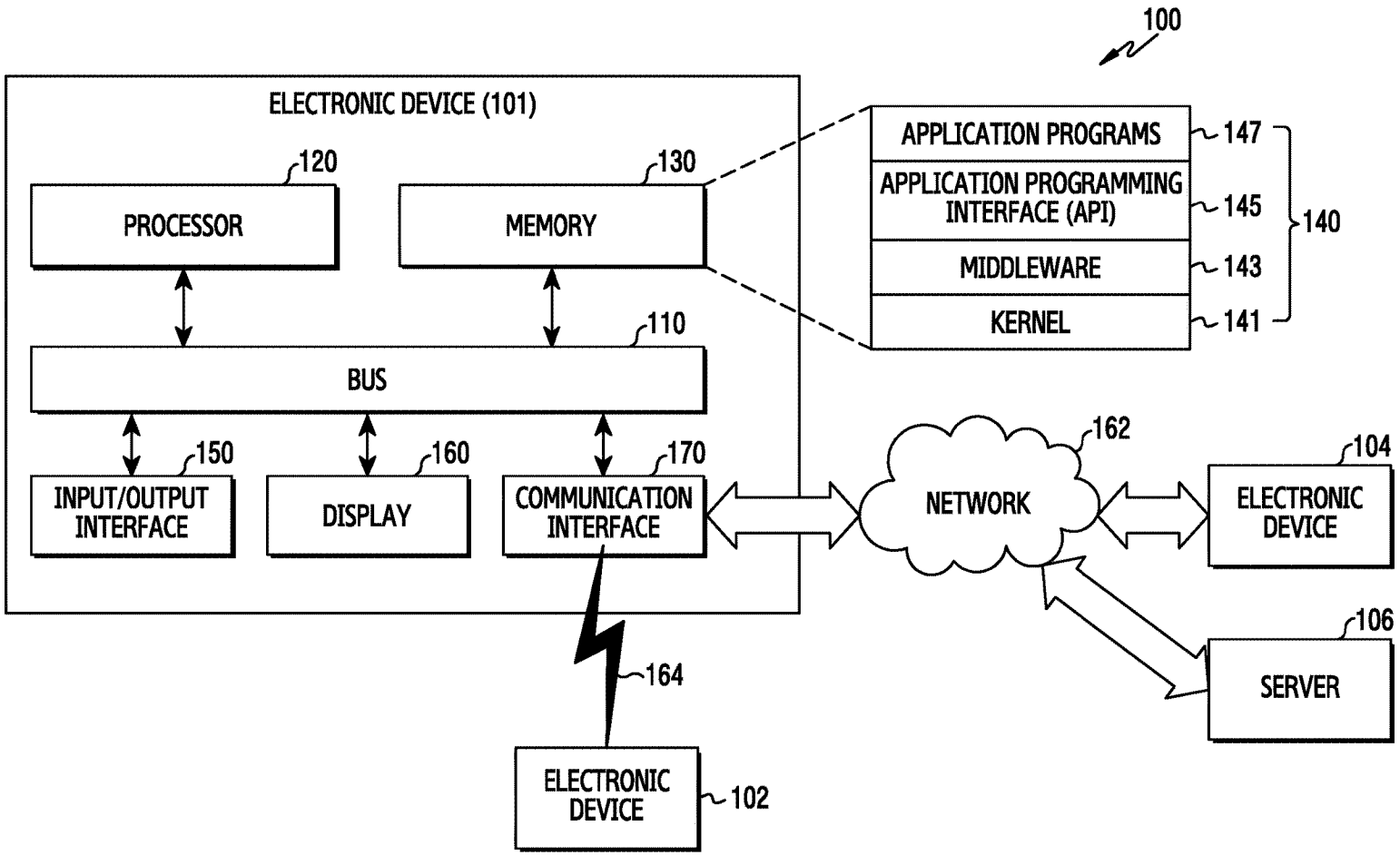
FIG. 1 illustrates a network environment including an electronic device according to embodiments of the present disclosure.

Embodiments of the present disclosure will be described herein below with reference to the accompanying drawings. However, the embodiments of the present disclosure are not limited to the specific embodiments and should be construed as including all modifications, changes, equivalent devices and methods, and/or alternative embodiments of the present disclosure. Descriptions of well-known functions and/or configurations will be omitted for the sake of clarity and conciseness.

The terms and words used in the following description and claims are not limited to their dictionary meanings, but are merely used to enable a clear and consistent understanding of the present disclosure. Accordingly, it should be apparent to those skilled in the art that the following description of embodiments of the present disclosure is provided for illustrative purposes only and not for the purpose of limiting the present disclosure as defined by the appended claims and their equivalents.

Singular terms "a," "an," and "the" include plural references unless the context clearly dictates otherwise. For example, reference to "a component surface" includes reference to one or more of such surfaces.

The embodiments are described herein by way of illustration only and should not be construed in any way to limit the scope of the present disclosure. Those skilled in the art will understand that the principles of the present disclosure may be implemented in any suitably arranged electronic device.

As used herein, the term "substantially" indicates that the recited characteristic, parameter, or value need not be achieved exactly, but that variations such as tolerances, measurement errors, measurement accuracy limitations and other factors known to those of ordinary skill in the art, may occur in amounts that do not preclude the effect the characteristic was intended to provide.

The expressions "have," "may have," "include," and "may include" as used herein indicate the presence of corresponding features, such as numerical values, functions, operations, or parts, and do not preclude the presence of additional features.

The expressions "A or B," "at least one of A or/and B," or "one or more of A or/and B" as used herein include all possible combinations of items enumerated with them. For example, "A or B," "at least one of A and B," or "at least one of A or B" indicate (1) including at least one A, (2) including at least one B, or (3) including both at least one A and at least one B.

Terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. A first element may be referred to as a second element without departing from the scope the present disclosure, and similarly, a second element may be referred to as a first element.

When an element, such as a first element, is "operatively or communicatively coupled with/to" or "connected to" another element, such as a second element, the first element may be directly coupled with/to the second element, and there may be an intervening element, such as a third element, between the first and second elements. To the contrary, when the first element is "directly coupled with/to" or "directly connected to" the second element, there is no intervening third element between the first and second elements.

The term "module" as used herein may imply a unit including one of hardware, software, and firmware, or a combination thereof, and may be interchangeably used with terms, such as unit, logic, logical block, component, or circuit. A module as described herein may be a minimum unit of an integrally constituted component or may be a part thereof, may be a minimum unit for performing one or more functions or may be a part thereof, and may be mechanically or electrically implemented. For example, a module may include at least one of an application-specific integrated circuit (ASIC) chip, field-programmable gate arrays (FPGAs), and a programmable-logic device, which are known or will be developed and which perform certain operations.

All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

Electronic devices according to the embodiments of the present disclosure may include at least one of smart phones, tablet personal computers (PCs), mobile phones, video telephones, electronic book readers, desktop PCs, laptop PCs, netbook computers, workstations, servers, personal digital assistants (PDAs), portable multimedia players (PMPs), motion picture experts group (MPEG-1 or MPEG-2) audio layer 3 (MP3) players, mobile medical devices, cameras, or wearable devices. The wearable devices may include at least one of accessory-type wearable devices, such as watches, rings, bracelets, anklets, necklaces, glasses, contact lenses, or head-mounted-devices (HMDs), fabric or clothing integral wearable devices, such as electronic clothes, body-mounted wearable devices, such as skin pads or tattoos, or implantable wearable devices, such as implantable circuits.

The electronic devices may be smart home appliances including at least one of televisions (TVs), digital versatile disk (DVD) players, audios, refrigerators, air conditioners, cleaners, ovens, microwave ovens, washing machines, air cleaners, set-top boxes, home automation control panels, security control panels, TV boxes, such as Samsung HomeSync™, Apple TV™, or Google TV™, game consoles, such as Xbox™ and PlayStation™, electronic dictionaries, electronic keys, camcorders, or electronic picture frames.

The electronic devices may include various portable medical measurement devices, such as blood glucose meters, heart rate monitors, blood pressure monitors, or thermometers, magnetic resonance angiography (MRA) devices, magnetic resonance imaging (MRI) devices, computed tomography (CT) devices, scanners, ultrasonic devices, navigation devices, global positioning system (GPS) receivers, event data recorders (EDRs), flight data recorders (FDRs), vehicle infotainment devices, electronic equipment for vessels, such as navigation systems and gyrocompasses, avionics, security devices, head units for vehicles, industrial or home robots, automated teller machines (ATMs), points of sales (POSs) devices, or Internet of Things (IoT) devices, such as light bulbs, various sensors, electric or gas meters, sprinkler devices, fire alarms, thermostats, street lamps, toasters, exercise equipment, hot water tanks, heaters, and boilers.

The electronic devices may further include at least one of parts of furniture or buildings/structures, electronic boards, electronic signature receiving devices, projectors, or various measuring instruments, such as water meters, electricity meters, gas meters, and wave meters, may be one or more combinations of the above-mentioned devices, and may be flexible electronic devices. The electronic devices are not limited to the above-mentioned devices, and may include new electronic devices according to the development of new technologies.

Hereinafter, the electronic devices according to embodiments of the present disclosure will be described with reference to the accompanying drawings. The term "user" as used herein may refer to a person who uses an electronic device or to an artificial intelligence electronic device which uses an electronic device.

FIG. 1 is a diagram illustrating a network environment including an electronic device, according to an embodiment of the present disclosure.

Referring to FIG. 1, a network environment 100 includes an electronic device 101 having a bus 110, a processor 120, a memory 130, an input/output interface 150, a display 160, and a communication interface 170. The electronic device 101 can omit at least one of the components or further include one or more additional components.

The bus 110 includes a circuit for connecting the components and delivering communications such as a control message therebetween.

The processor 120 includes one or more of a central processing units (CPUs), an application processor (AP), and a communication processor (CP). The processor 120 processes an operation or data on control of and/or communication with another component of the electronic device 101, and may include a microprocessor or any suitable type of processing circuitry, such as one or more general-purpose processors, such as advanced reduced instruction set computer machines (ARM)-based processors, a digital signal processor (DSP), a programmable logic device (PLD), an application-specific integrated circuit (ASIC), a field-programmable gate array (FPGA), a graphical processing unit (GPU), and a video card controller. When a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in entirety or in part within the programmed instructions of a computer. In addition, an artisan understands and appreciates that a "processor" or "microprocessor" may be hardware in the claimed disclosure.

The processor 120, which can be connected to a long term evolution (LTE) network, determines whether a call is connected over a circuit switched (CS) service network, such as a 2nd generation (2G) or 3rd generation (3G) network, using caller identification information. For example, the processor 120 receives incoming call information, such as a CS notification message or a paging request message of the CS service network over the LTE network, such as circuit-switched fallback (CSFB), and receives incoming call information, such as a paging request message over the CS service network, such as single radio LTE (SRLTE).

When receiving an incoming CS notification message or a paging request message of the CS service network over the LTE network, the processor 120 obtains caller identification information from the incoming call information, displays the caller identification information on the display 160, and determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection, and when detecting input information corresponding to an incoming call acceptance, through the input/output interface 150, the processor 120 connects the voice call by connecting to the CS service network.

When receiving the incoming CS notification message or a paging request message of the CS service network over the LTE network, the processor 120 obtains caller identification information from the incoming call information, and determines whether to connect the call by comparing the caller identification information with a reception control list. For example, when the caller identification information is included in a first reception control list, such as a blacklist, the processor 120 restricts the voice call connection and maintains the connection to the LTE network. When the caller identification information is not included in the blacklist, the processor 120 connects the voice call by connecting to the CS service network. When the caller identification information is included in a second reception control list, such as a white list, the processor 120 connects the voice call by connecting to the CS service network.

When receiving the incoming call information, such as a paging request message of the CS service network over the LTE network, the processor 120 sends an incoming call response message, such as a paging response message, to the CS service network, suspends the LTE service, and receives the caller identification information, such as a circuit-switched call (CC) setup message, from the CS service network. The processor 120 determines whether to connect the call by comparing the caller identification information with the reception control list. For example, when the caller identification information is included in the blacklist, the processor 120 restricts the voice call connection and resumes the LTE network connection, and when the caller identification information is not included in the he blacklist, the processor 120 connects the voice call by connecting to the CS service network. For example, when the caller identification information is included in the white list, the processor 120 connects the voice call by connecting to the CS service network.

The memory 130 can include volatile and/or nonvolatile memory, stores commands or data, such as the reception control list relating to at least another component of the electronic device 101, and may store software and/or a program 140 including a kernel 141, middleware 143, an application programming interface (API) 145, and/or application programs (or applications) 147. At least some of the kernel 141, the middleware 143, and the API 145 may be referred to as an operating system (OS).

The kernel 141 controls or manages system resources, such as the bus 110, the processor 120, or the memory 130 used for performing an operation or function implemented by the other programs, such as the middleware 143, the API 145, or the applications 147, and provides an interface through which the middleware 143, the API 145, or the applications 147 connects the individual elements of the electronic device 101 to control or manage the system resources.

The middleware 143 functions as an intermediary for enabling the API 145 or the applications 147 to communicate with the kernel 141 to exchange data.

In addition, the middleware 143 processes one or more task requests received from the applications 147 according to priorities thereof. For example, the middleware 143 assigns priorities for using the system resources of the electronic device 101, to at least one of the applications 147, and may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function, such as an instruction for file control, window control, image processing, or text control.

The input/output interface 150 functions as an interface that transfers instructions or data input from a user or another external device to the other element(s) of the electronic device 101, and outputs the instructions or data received from the other element(s) of the electronic device 101 to the user or an external electronic device.

The display 160 may include a liquid crystal display (LCD), a light emitting diode (LED) display, an organic LED (OLED) display, a micro electro mechanical system (MEMS) display, and an electronic paper display. The display 160 displays various types of content, such as text, images, videos, icons, or symbols for the user, may include a touch screen that receives a touch, gesture, proximity, or hovering input using an electronic pen or a user's body part, such as a finger, and may display a web page.

The communication interface 170 can establish a communication between the electronic device 101 and an external electronic device, such as a first external electronic device 102, a second external electronic device 104, or a server 106, in connection to the network 162 through wireless or wired communication or via short-range communication 164. For example, the wireless communication can conform to a cellular communication protocol including at least one of long term evolution (LTE), LTE-advanced (LTE-A), code division multiple access (CDMA), wideband CDMA (WCDMA), universal mobile telecommunication system (UMTS), wireless broadband (WiBro), and global system for mobile communications (GSM).

The wired communication can include at least one of a universal serial bus (USB), a high definition multimedia interface (HDMI), a recommended standard 232 (RS-232), and a plain old telephone service (POTS).

The network 162 can include a telecommunications network, such as local area network (LAN) or wide area network (WAN), the Internet, and a telephone network.

The electronic device 101 provides LTE service in the single radio environment by use of at least one module functionally or physically separated from the processor 120.

Each of the first and second external electronic devices 102 and 104 may be a type of device that is the same as or different from the electronic device 101. The server 106 may include a group of one or more servers. All or some of the operations to be executed by the electronic device 101 may be executed by the external electronic devices 102 and 104 or the server 106. When the electronic device 101 performs a certain function or service automatically or by request, the electronic device 101 may request some functions that are associated therewith from another electronic device instead of or in addition to executing the function or service by itself. The external electronic devices 102 and 104 or the server 106 may execute the requested functions or additional functions, and may transmit the results to the electronic device 101, which provides the requested functions or services by processing the received results. For example, a cloud computing, distributed computing, or client-server computing technique may be used.

Figure 2:
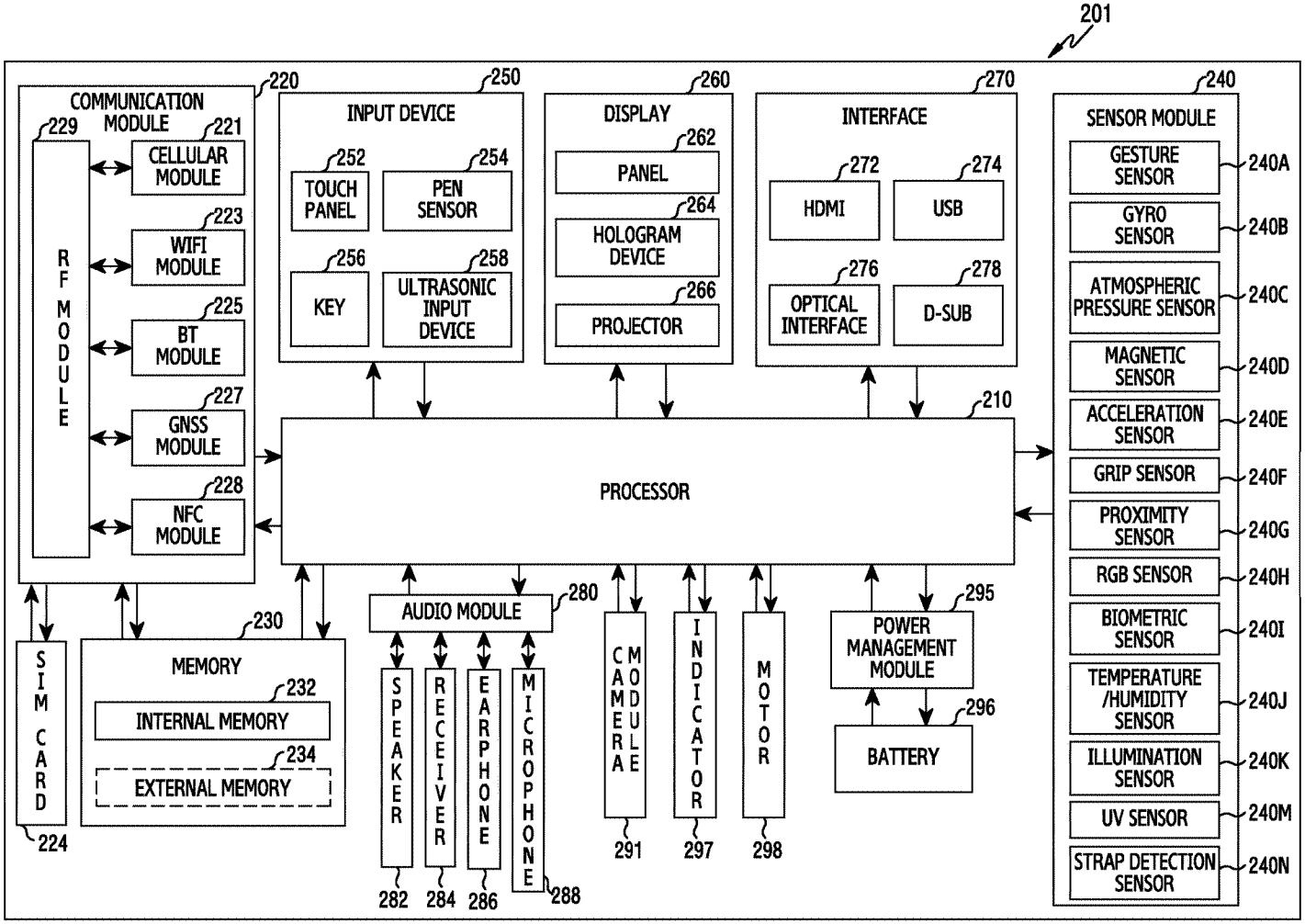
FIG. 2 is a block diagram of an electronic device according to embodiments of the present disclosure.

FIG. 2 is a diagram of a configuration of an electronic device, according to an embodiment of the present disclosure.

Referring to FIG. 2, the electronic device 201 includes at least one processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 controls a plurality of hardware or software elements connected to the AP 210 by driving an OS or an application program, processes a variety of data, including multimedia data, performs arithmetic operations, may be implemented with a system on chip (SoC) and may further include a graphical processing unit (GPU).

The communication module 220 performs data transmission/reception in communication between the external electronic devices 102, 104 or the server 106 which may be connected with the electronic device 201 through the network 162. The communication module 220 includes a cellular module 221, a wireless-fidelity (Wi-Fi) module 223, a Bluetooth® (BT) module 225, a global navigation satellite system (GNSS) or GPS module 227, a near field communication (NFC) module 228, and a radio frequency (RF) module 229.

The cellular module 221 provides a voice call, a video call, a text service, or an Internet service, such as through a communication network including LTE, LTE-A, CDMA, WCDMA, UMTS, WiBro, or GSM, for example. In addition, the cellular module 221 identifies and authenticates the electronic device 201 within the communication network by using the SIM card 224, and may perform at least some of the functions that can be provided by the AP 210, such as multimedia control functions.

The cellular module 221 includes a CP and may be implemented with an SoC. Although elements, such as the cellular module 221, the memory 230, and the power management module 295 are illustrated as separate elements with respect to the AP 210 in FIG. 2, the AP 210 may also be implemented such that at least one module of the aforementioned elements is included in the AP 210.

The AP 210 or the cellular module 221 loads an instruction or data, which is received from each non-volatile memory connected thereto or at least one of different elements, to a volatile memory, processes the instruction or data, and stores data which is received from or generated by at least one of different elements, into the non-volatile memory.

Each of the Wi-Fi module 223, the BT module 225, the GNSS module 227, and the NFC module 228 includes a processor for processing data transmitted/received through a corresponding module. Although the cellular module 221, the Wi-Fi module 223, the BT module 225, the GNSS module 227, and the NFC module 228 are illustrated in FIG. 2 as separate blocks, at least two of these modules may be included in one integrated chip (IC) or IC package. For example, at least some of processors corresponding to these modules, such as a communication processor corresponding to the cellular module 221 and a Wi-Fi processor corresponding to the Wi-Fi module 223, may be implemented with an SoC.

The RF module 229 transmits/receives data, such as an RF signal, and may include a transceiver, a power amp module (PAM), a frequency filter, or a low noise amplifier (LNA), for example. In addition, the RF module 229 may further include a component for transmitting/receiving a radio wave on a free space in wireless communication, including a conductor or a conducting wire. The cellular module 221, the Wi-Fi module 223, the BT module 225, the GNSS module 227, and the NFC module 228 may share one RF module 229, and at least one of these modules may transmit/receive an RF signal via a separate RF module.

The SIM card 224 may be inserted into a slot formed at a specific location of the electronic device 201, and includes unique identification information, such as an integrated circuit card identifier (ICCID) or subscriber information, such as an international mobile subscriber identity (IMSI).

The memory 230 includes an internal memory 232 and an external memory 234.

The internal memory 232 may include at least one of a volatile memory, such as a dynamic random access memory (DRAM), a static RAM (SRAM), and a synchronous dynamic RAM (SDRAM) or a non-volatile memory, such as a one-time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, and a not or (NOR) flash memory. The internal memory 232 may be a solid state drive (SSD).

The external memory 234 may include a flash drive, a compact flash (CF), secure digital (SD), micro-SD, mini-SD, extreme digital (xD), and a memory stick, and may be operatively coupled to the electronic device 201 via various interfaces.

The electronic device 201 may further include a storage unit, such as a hard drive.

The sensor module 240 measures a physical quantity or detects an operation state of the electronic device 201, and converts the measured or detected information into an electric signal. The sensor module 240 includes at least one of a gesture sensor 240A, a gyro sensor 240B, a barometric pressure sensor or air sensor 240C, a magnetic sensor 240D, an acceleration sensor 240E, a grip sensor 240F, a proximity sensor 240G, a color sensor 240H, such as a red, green, blue (RGB) sensor, a biometric sensor 240I, a temperature/humidity sensor 240J, an illumination/illuminance sensor 240K, an ultraviolet (UV) sensor 240M and a strap detection sensor 240N.

Additionally or alternatively, the sensor module 240 may include an E-node sensor, an electromyography (EMG) sensor, an electroencephalogram (EEG) sensor, an electrocardiogram (ECG) sensor, and a fingerprint sensor.

The sensor module 240 may further include a control circuit for controlling at least one or more sensors included therein.

According to embodiments, the processor 210 may receive, from the strap detection sensor 240N, state information indicating that the strap has been separated from the housing, and may control the display 260 based on the corresponding state information to provide visual notification information of the separation to a user. Without being limited thereto, however, the processor 210 may also control the audio module 280 to acoustically provide the notification information to the user. According to one embodiment, the processor 210 may also control the motor 298, such as a vibrator, to provide the notification information to the user in a tactile manner.

The input device 250 includes a touch panel 252, a (digital) pen sensor 254, a key 256, and an ultrasonic input unit 258.

The touch panel 252 recognizes a touch input by using at least one of an electrostatic, pressure-sensitive, and ultrasonic type configuration, and may further include a control circuit. When the touch panel is of the electrostatic type, both physical contact recognition and proximity recognition are possible. The touch panel 252 may further include a tactile layer, which provides the user with a tactile reaction.

The (digital) pen sensor 254 may include a recognition sheet which can be a part of or separately implemented from the touch panel. The key 256 may include a physical button, an optical key, or a keypad. The ultrasonic input device 258 may detect ultrasonic waves generated by an input tool through a microphone 288, and may confirm data corresponding to the detected ultrasonic waves.

The (digital) pen sensor 254 may be implemented using the same or similar method of receiving a touch input of a user or using an additional recognition sheet.

The key 256 may be a physical button, an optical key, a keypad, or a touch key.

The ultrasonic input unit 258 detects a reflected sound wave through the microphone 288 and is capable of radio recognition. For example, an ultrasonic signal, which may be generated by using a pen, may be reflected off an object and detected by the microphone 288.

The electronic device 201 may use the communication module 220 to receive a user input from an external device, such as a computer or a server connected thereto.

The display 260 includes a panel 262, a hologram 264, and a projector 266.

The panel 262 may be a liquid crystal display (LCD) or an active matrix organic light-emitting diode (AM-OLED) type, for example, may be implemented in a flexible, transparent, or wearable manner, and may be constructed as one module with the touch panel 252.

The hologram device 264 uses an interference of light and displays a stereoscopic image in the air.

The projector 266 displays an image by projecting a light beam onto a screen, which is located inside or outside the electronic device 201.

The display 260 may further include a control circuit for controlling the panel 262, the hologram device 264, and the projector 266.

The interface 270 may include an HDMI 272, a USB 274, an optical communication interface 276, and a d-subminiature (D-sub) 278, may be included in the communication interface 170 of FIG. 1, and may include a mobile high-definition link (MHL), SD/multi-media card (MMC) or infrared data association (IrDA).

The audio module 280 bilaterally converts a sound and an electric signal. At least some elements of the audio module 280 may be included in the input/output interface 150 of FIG. 1. The audio module 280 converts sound information which is input or output through a speaker 282, a receiver 284, an earphone 286, or the microphone 288.

The speaker 282 may output a signal of an audible frequency band and a signal of an ultrasonic frequency band. Reflected waves of an ultrasonic signal emitted from the speaker 282 and a signal of an external audible frequency band may be received.

The camera module 291 provides image and video capturing, and may include one or more image sensors, such as a front sensor and a rear sensor, a lens, an image signal processor (ISP), and a flash, such as an LED or a xenon lamp. In certain instances, the electronic device 201 may include two or more camera modules.

The power management module 295 manages power of the electronic device 201, and may include a power management integrated circuit (PMIC), a charger IC, or a battery gauge.

The PMIC may be placed inside an IC or an SoC semiconductor and may use a wired charging and/or a wireless charging method. The charger IC can charge a battery and can prevent an over-voltage or over-current flow.

Different types of wireless charging may include magnetic resonance, magnetic induction, and electromagnetic types. An additional circuit for the wireless charging, such as a coil loop, a resonant circuit, or a rectifier may be added.

The battery gauge may measure a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a specific state, such as a booting, message, or charging state of the electronic device 201 or a part thereof, such as the AP 210.

The motor 298 converts an electric signal into a mechanical vibration.

The electronic device 201 includes a processing unit, such as a GPU, for supporting mobile TV which processes media data according to a protocol of digital multimedia broadcasting (DMB), digital video broadcasting (DVB), or media flow.

Each of the aforementioned elements of the electronic device 201 may include one or more components, and names thereof may vary depending on a type of the electronic device 201. Some of the elements may be omitted, or additional other elements may be further included. In addition, some of the elements of the electronic device 201 may be combined and constructed as one entity, so as to equally perform functions of corresponding elements prior to the combination.

At least some parts of the electronic device 201, such as modules or functions thereof, or operations, may be implemented with an instruction stored in a non-transitory computer-readable storage media for example. The instruction may be executed by the processor 210, to perform a function corresponding to the instruction. The non-transitory computer-readable storage media may be the memory 230. At least part of the programming module may be executed by the processor 210 and may include modules, programs, routines, and a set of instructions for performing one or more functions.

An electronic device according to embodiments of the present disclosure is illustrated as a wearable electronic device that can be worn on a user's body, and will hereinafter be described in detail. However, without being limited thereto, embodiments of the present disclosure may be applied to various devices including straps having a plurality of unit links connected together, and that can be fastened to a housing, such as a main body.

Figure 3A:
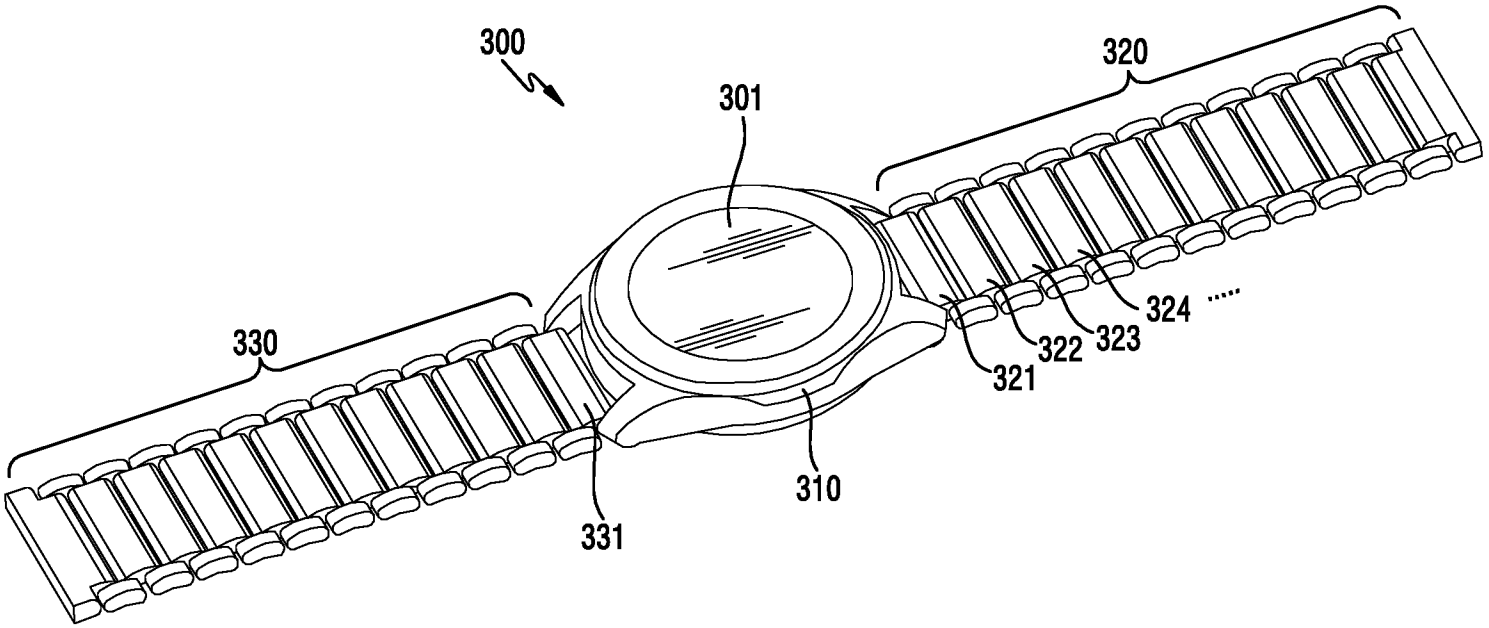
FIG. 3A is a front perspective view of a wearable electronic device according to embodiments of the present disclosure.

FIG. 3A is a front perspective view of a wearable electronic device according to embodiments of the present disclosure.

Referring to FIG. 3A, the electronic device 300 is a wrist-wearable electronic device that can be worn on a user's wrist, according to an embodiment of the present disclosure. In FIG. 3A, the electronic device 300 may include a housing 310 that is used as a main body, and one or more straps 320 and 330, such as connecting, binding, or chain members, each being attached to at least one region of the housing 310. According to one embodiment, the electronic device 300 may be worn on the wrist by placing the housing 310 on the wrist and then wrapping the straps 320 and 330 around the wrist. One strap 320 may have a buckle member attached thereto, and the other strap 330 may have a fastening part formed thereon, to which the buckle member is fastened. The strap 320 may include a plurality of unit links 321, 322, 323, and 324 connected together to rotate relative to each other, and the other strap 330 may also have the same configuration. The straps 320 and 330 may be formed of metal, ceramic, or synthetic resin.

According to embodiments, the housing 310 may include a display 301 which may be used as a touch screen device including a touch sensor, and may include a pressure sensor. At least one key button may be disposed at an appropriate place of the housing 310. The electronic device 300 may have a rechargeable battery therein as a power supply unit, and may include a wireless charging coil member for recharging the battery. The electronic device 300 may also include at least one antenna device for communication. The antenna device may have at least one conductive pattern, such as antenna radiation pattern, that is disposed in the electronic device 300 in a variety of manners, and may be implemented such that the electronic device 300 is selectively mounted on a portable wireless charging cradle to recharge the battery.

According to embodiments, the electronic device 300 may include an annular member mounted on the housing 310 so as to be rotatable. The annular member may be provided to surround the entirety of the display 301 mounted on the housing 310. When the electronic device 300 is a wrist-wearable electronic device, the annular member may be provided in the form of a rotatable bezel. The annular member may rotate in the clockwise or counterclockwise direction, and may be configured to rotate up to 360 degrees or to rotate freely without any limitation. The electronic device 300 may detect rotation parameters of the annular member and may perform relevant functions based on the detected parameters.

The housing 310 may include at least one sensor device disposed in at least one region thereof. According to one embodiment, the sensor device may include at least one of a camera sensor, a fingerprint recognition sensor, an infrared sensor, a heart rate monitor (HRM) sensor, a photo sensor, a proximity sensor, an illuminance sensor, a temperature sensor, and an iris recognition sensor.

Figure 3B:
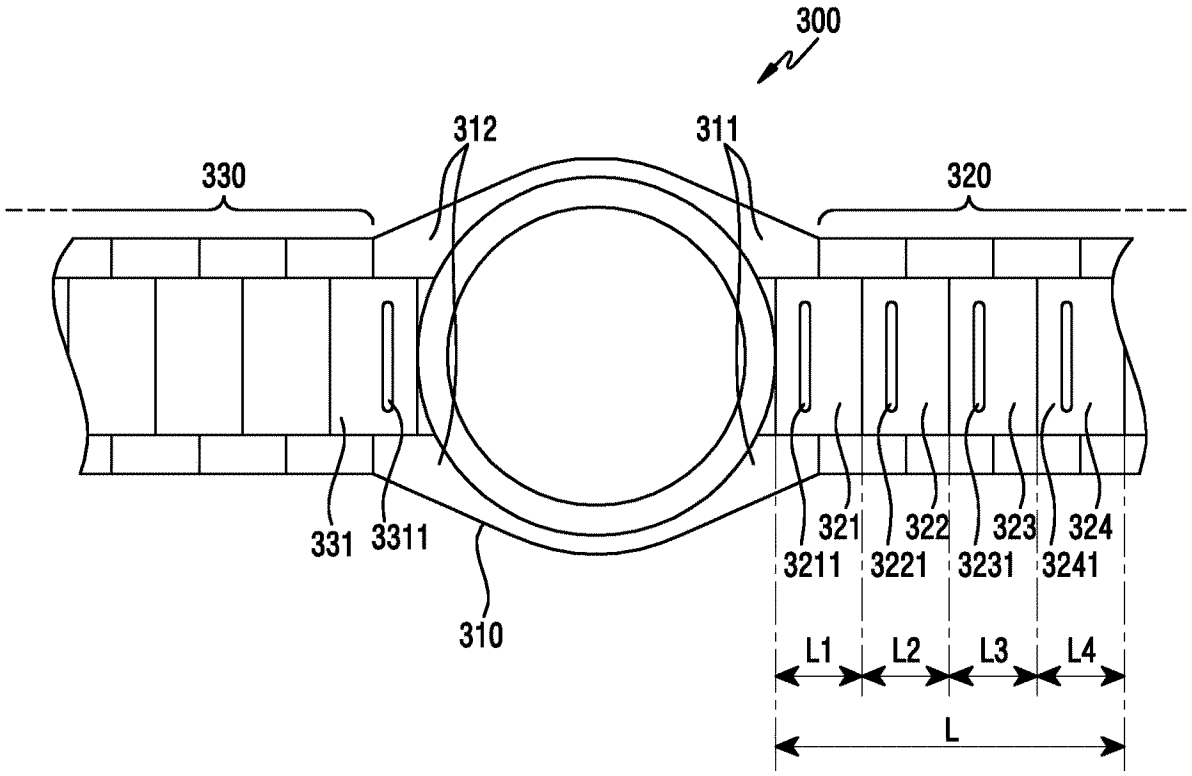
FIG. 3B is a rear view of the electronic device of FIG. 3A according to embodiments of the present disclosure.

FIG. 3B is a rear view of the electronic device of FIG. 3A according to embodiments of the present disclosure.

Referring to FIG. 3B, the wearable electronic device 300 may include the housing 310 and the pair of straps 320 and 330 fastened to strap-fastening parts 311 and 312 formed respectively on opposite ends of the housing 310. According to one embodiment, the pair of straps 320 and 330 may include the first strap 320 fastened to the first strap-fastening part 311 formed on one side of the housing 310 and the second strap 330 fastened to the second strap-fastening part 312 formed on the opposite side of the housing 310.

According to embodiments, the pair of straps 320 and 330 may each include a buckle member on the free end thereof. The electronic device 300 may be worn on a user's wrist in such a manner as to wrap the straps 320 and 330 around the wrist and couple the free ends of the respective straps 320 and 330 together using the buckle members.

According to embodiments, the straps 320 and 330 may include the plurality of unit links 321, 322, 323, and 324 having predetermined lengths L1, L2, L3, and L4 that form the length L of the strap 320, wherein the unit links 321, 322, 323, and 324 are fastened and connected together so as to be rotatable relative to each other, may be formed of metal, ceramic, or a synthetic resin, and may have identical or different lengths.

According to embodiments, the strap 320 may include the first unit link 321 fastened to the strap-fastening part 311 of the housing 310, the second unit link 322 fastened to the first unit link, the third unit link 323 fastened to the second unit link, and the fourth unit link 324 fastened to the third unit link. The respective unit links 321, 322, 323, 324 may include buttons 3211, 3221, 3231, 3241 exposed to the outside. As will be described below, by pressing the buttons 3211, 3221, 3231, and 3241 exposed from the respective unit links 321, 322, 323, and 324, the first unit link 321 may be separated from the strap-fastening part 311 of the housing 310, and the second to fourth unit links 322, 323, and 324 may also be easily separated from each other.

According to embodiments, the overall length of the strap 320 may be adjusted by removing at least one of the unit links 321, 322, 323, and 324, or by adding another unit link. The overall length L of the strap 320 may include the lengths L1, L2, L3, and L4 of the first to fourth unit links 321, 322, 323, and 324. For example, the strap 320 may have the length L1+L3+L4, exclusive of the length L2 of the second unit link, by separating the second unit link 322 from the first unit link 321 by pressing the corresponding button 3221, and then separating the third unit link 323 from the second unit link 322 by pressing the corresponding button 3231. The strap 320 may be configured such that the overall length thereof is increased by adding at least one unit link between the existing unit links 321, 322, 323, and 324. As illustrated in the drawing, the four unit links 321, 322, 323, and 324 have the respective buttons, but according to one embodiment, all the unit links constituting the strap may include respective buttons. The other strap 330 may also be easily separated from the strap-fastening part 312 formed on the housing 310 by pressing the corresponding button 3311 formed on a unit link 331.

Figure 4A:
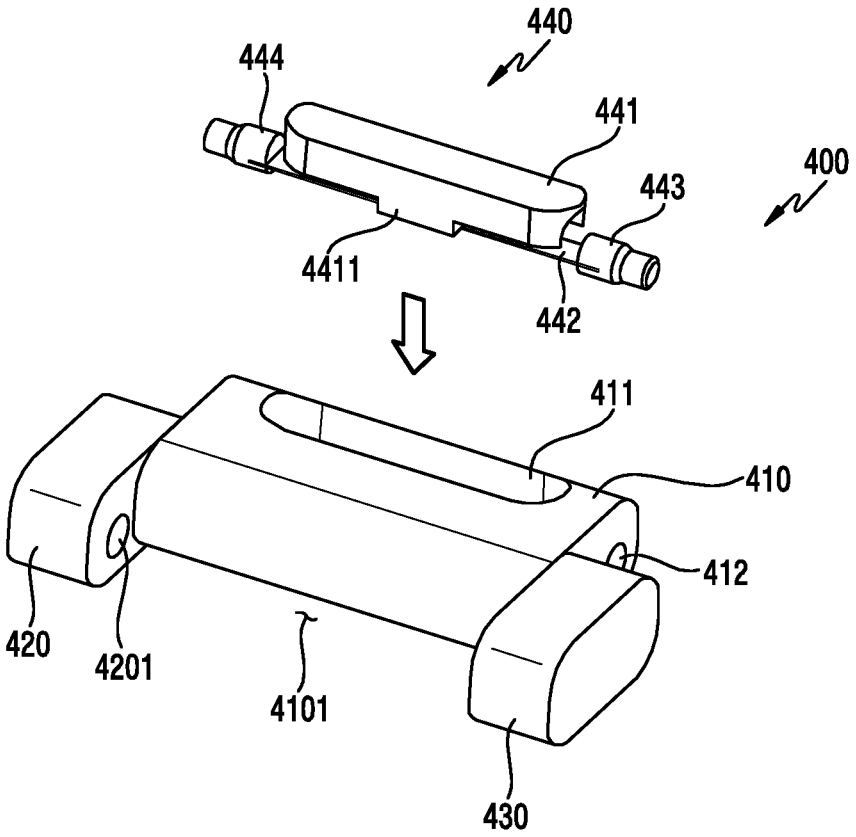
FIG. 4A is an exploded perspective view of a unit link according to embodiments of the present disclosure.
Figure 4B:
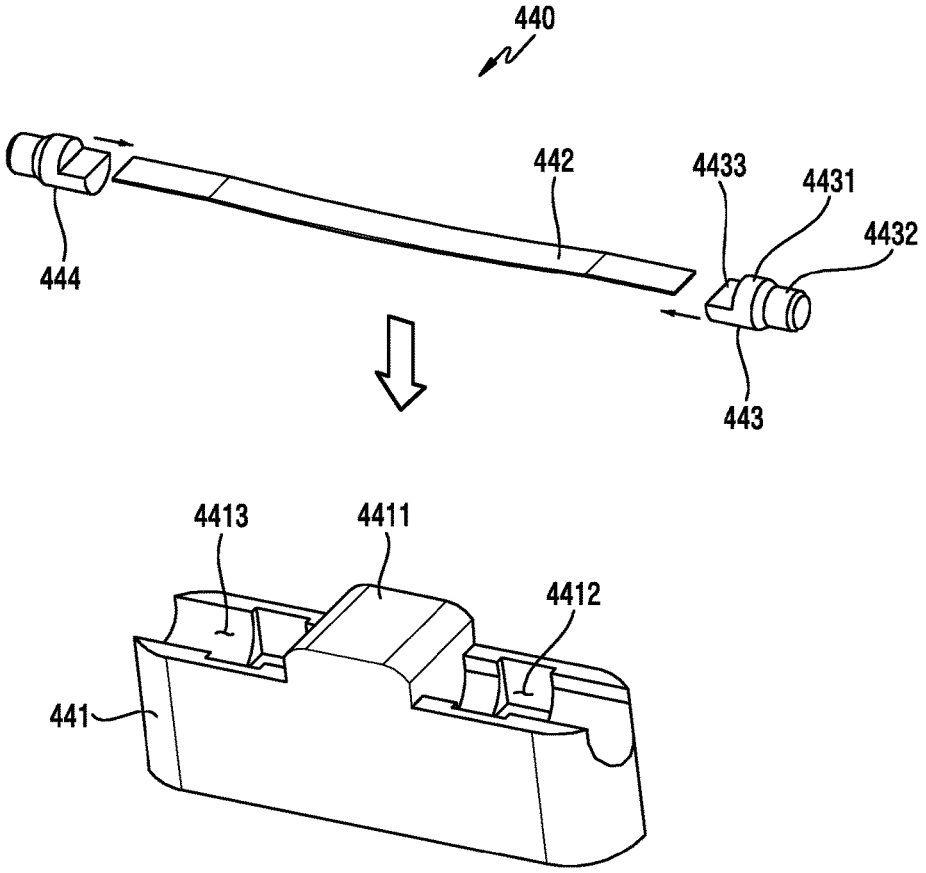
FIG. 4B is an exploded perspective view of a button assembly according to embodiments of the present disclosure.

FIG. 4A is an exploded perspective view of a unit link according to embodiments of the present disclosure. FIG. 4B is an exploded perspective view of a button assembly according to embodiments of the present disclosure.

The unit link 400 of FIG. 4A may be similar to the unit links 321, 322, 323, and 324 of FIG. 3A, or may include other embodiments of the unit links.

Referring to FIGS. 4A and 4B, the unit link 400 may include a link body 410 having a rectangular parallelepiped shape and a button assembly 440 coupled to the link body 410. According to one embodiment, the link body 410 may include a pair of link blocks 420 and 430 disposed on the left and right sides thereof and protruding from opposite ends of the link body 410 in one direction to form a body-receiving space 4101 for receiving at least a part of the link body of an adjacent unit link. The link blocks 420 and 430 may be integrally formed with the link body 410, or may be provided as separate structures and may be secured to the link body 410 by press-fit pins.

According to one embodiment, each of the link blocks 420 and 430 may include a pin-receiving hole 4201 formed in the inside surface thereof to receive a hinge pin provided at the adjacent unit link. The link body 410 may include a button-receiving groove 411 formed therein in the width direction, may include hinge-pin-receiving holes 412 and 413 formed in opposite side surfaces thereof, and may be formed such that the button-receiving groove 411 and the hinge-pin-receiving holes 412 and 413 communicate with each other. A pair of hinge pins 443 and 444 of the button assembly 440 mounted in the button-receiving groove 411 may partially protrude through the hinge-pin-receiving holes 412 and 413 (see FIG. 4C).

According to embodiments, the button assembly 440 may include a button 441 including a rib-fixing protrusion 4411, a tension rib 442 having a predetermined length and secured to the rib-fixing protrusion 4411 of the button 441, and the pair of hinge pins 443 and 444 secured to opposite ends of the tension rib 442. The button 441 may be formed of metal, synthetic resin, or ceramic, such that the rib-fixing protrusion 4411 made of metal is double-injection molded or insert molded into a body made of a synthetic resin, and may include rib-receiving spaces 4412 and 4413 formed on the left and right sides of the rib-fixing protrusion 4411. The rib-receiving spaces 4412 and 4413 may be formed to have a depth sufficient to receive portions bent according to deformation of the tension rib 442 secured to the rib-fixing protrusion 4411.

According to embodiments, the tension rib 442 may be secured to the rib-fixing protrusion 4411 of the button assembly 440. When the rib-fixing protrusion 4411 is formed of metal, the tension rib 442 may be secured to the rib-fixing protrusion 4411 through soldering or welding. Without being limited thereto, however, the tension rib 442 may be secured to the rib-fixing protrusion 4411 by various methods, such as bonding or taping, may be formed of various resilient materials that can return to the original shapes thereof when an external force applied thereto to cause deformation is released, may be formed of metal, such as aluminum or stainless steel (SUS), or a synthetic resin, and may be formed in a plate spring type or a string type.

According to embodiments, the pair of hinge pins 443 and 444 may be secured to opposite ends of the tension rib 442, respectively, may be formed of metal, a synthetic resin, or ceramic, and may be secured to the opposite ends of the tension rib 442 by soldering, bonding, welding, or taping.

According to embodiments, the hinge pin 443 may include a stopper 4431 having a constant cross-sectional area, a protrusion 4432 extending from one end of the stopper 4431 and having a smaller cross-sectional area than the stopper 4431, and a fixing part 4433 to which an end portion of the tension rib 442 is secured, the fixing part 4433 extending from an opposite end of the stopper 4431. The fixing part may include a partially D-cut flat surface, and the tension rib 442 may be secured to the corresponding flat surface. The hinge pin 443 may be inserted into the hinge-pin-receiving hole 412 of the link body 410 such that the protrusion 4432 protrudes from the link body 410, and may have a circular cross-section since the hinge pin 443 protruding through the link body 410 has to rotate after the hinge pin 443 is inserted into a pin-receiving hole formed in a link block of an adjacent unit link.

Figure 4C:
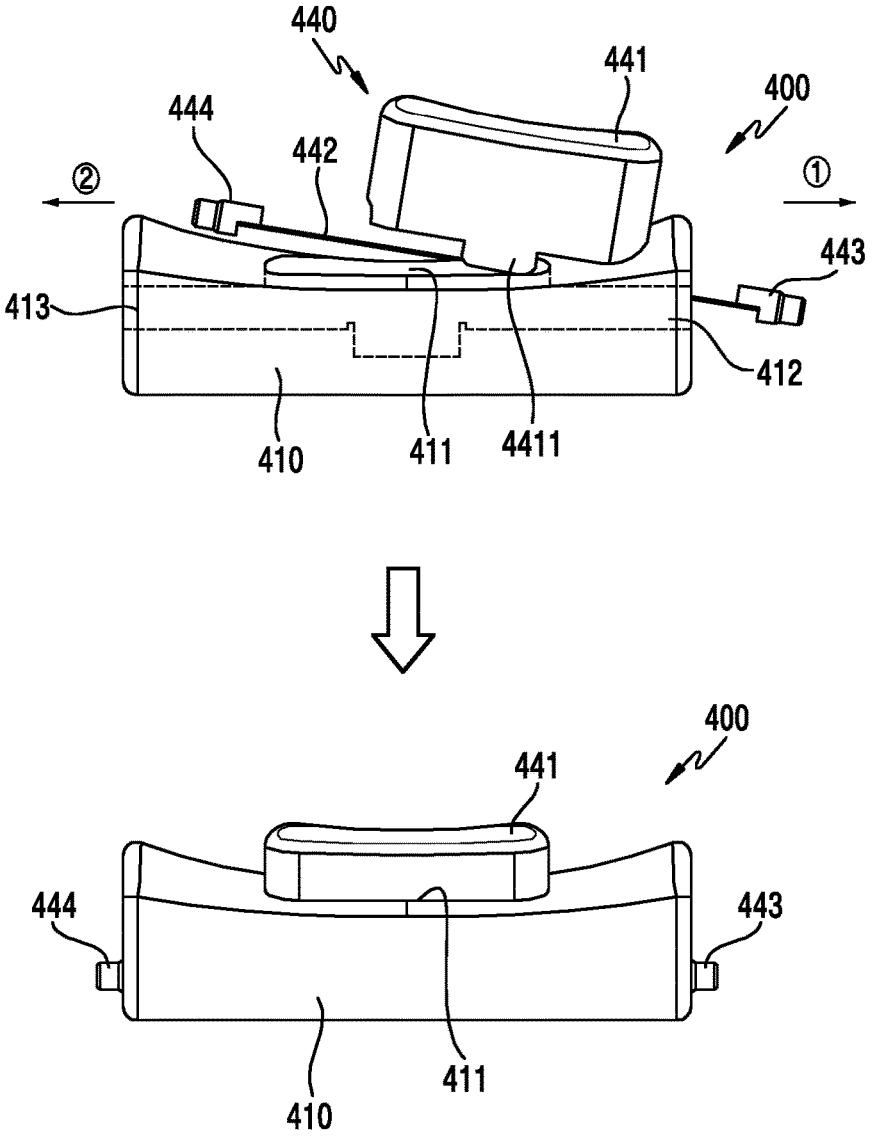
FIG. 4C illustrates a sequence in which the button assembly is assembled to the unit link according to embodiments of the present disclosure.

FIG. 4C illustrates a sequence in which the button assembly is assembled to the unit link according to embodiments of the present disclosure.

Referring to FIG. 4C, the button assembly 440, which is configured such that the tension rib 442 including the hinge pins 443 and 444 fixed to the opposite ends thereof is secured to the rib-fixing protrusion 4411 of the button 441, may be mounted through the button-receiving space 411 in the link body 410. According to one embodiment, the button assembly 440 may be inclined toward one direction and may then be mounted such that the first hinge pin 443 and the corresponding portion of the tension rib 442 protrude through the first hinge-pin-receiving hole 412 (in the direction ① of FIG. 4C) via the button-receiving groove 411. In this case, the tension rib 442 and the first hinge pin 443 may maximally protrude through the first hinge-pin-receiving hole 412. The second hinge pin 444 may move toward the rib-fixing protrusion 441 in this state to the extent to which the restoring force of the corresponding portion of the tension rib 442 does not vanish, and then the second hinge pin 444 and the corresponding portion of the tension rib 442 may protrude through the button-receiving groove 411 and the second hinge-pin-receiving hole 413 (in the direction ② of FIG. 4C).

When the button assembly 440 is completely assembled to the unit link, at least a part of the button 441 may be exposed through the button-receiving groove 411 in the link body 410, and the button 441 may be pressed into the button-receiving groove 411. According to one embodiment, the top of the button 441 mounted in the button-receiving groove 411 may be located at the same level as the top of the link body 410, or may be located lower than, or higher than, the top of the link body 410. The first and second hinge pins 443 and 444, which are secured to the opposite ends of the tension rib 442, respectively, and protrude through the first and second hinge-pin-receiving holes 412 and 413 in the link body 410, may prevent the button 441 from being separated from the button-receiving groove 411.

Figure 4D:
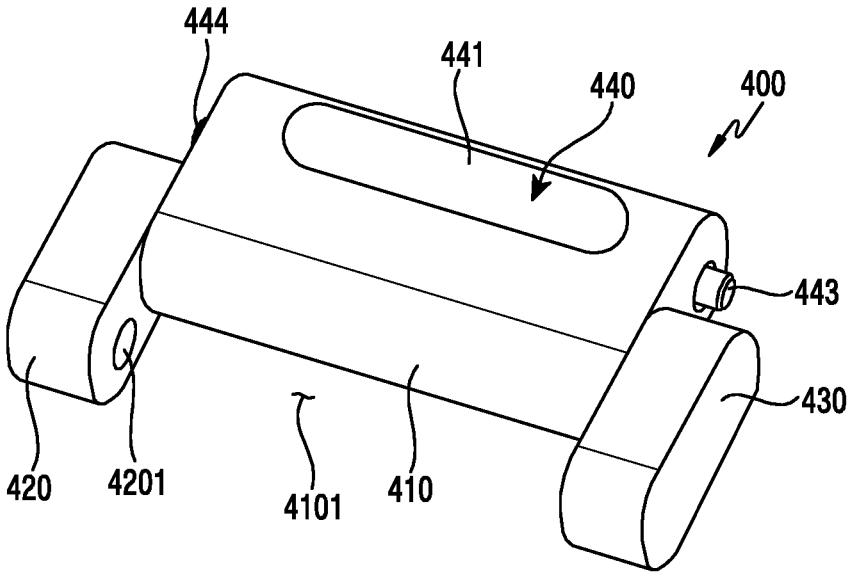
FIG. 4D illustrates the button assembly completely assembled to the unit link according to embodiments of the present disclosure.

FIG. 4D illustrates the button assembly completely assembled to the unit link according to embodiments of the present disclosure.

Referring to FIG. 4D, the button 441 may be exposed to the outside from the link body 410 of the unit link 400 when the link body 410 and the button assembly 440 are completely assembled together through the process of FIG. 4C. According to one embodiment, the exposed button 441 may be pressed into the link body 410, and the tension rib 442 of FIG. 4C may be deformed by the pressing of the button 441 and the internal structure of the button-receiving groove 411 of the link body 410 such that the horizontal length of the tension rib 442 decreases. As a result, the first and second hinge pins 443 and 444 protruding from the opposite sides of the link body 410 may move into the link body 410. This operation will be described below in detail.

Figure 5A:
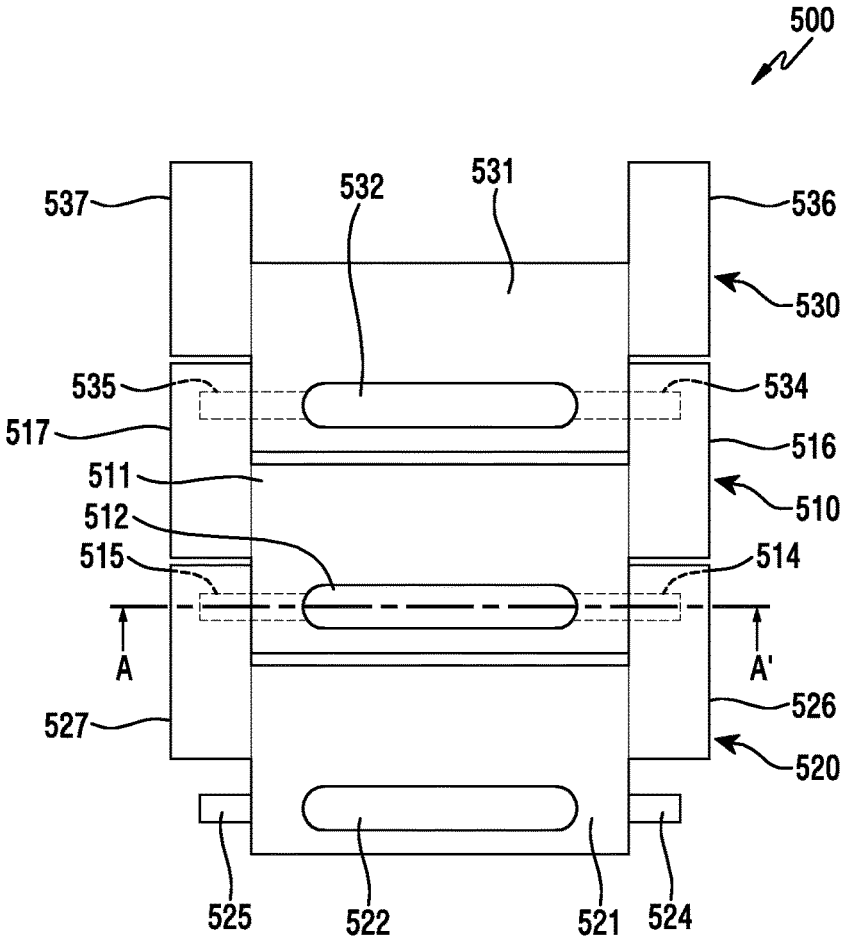
FIG. 5A illustrates a plurality of unit links coupled together according to embodiments of the present disclosure.
Figure 5B:
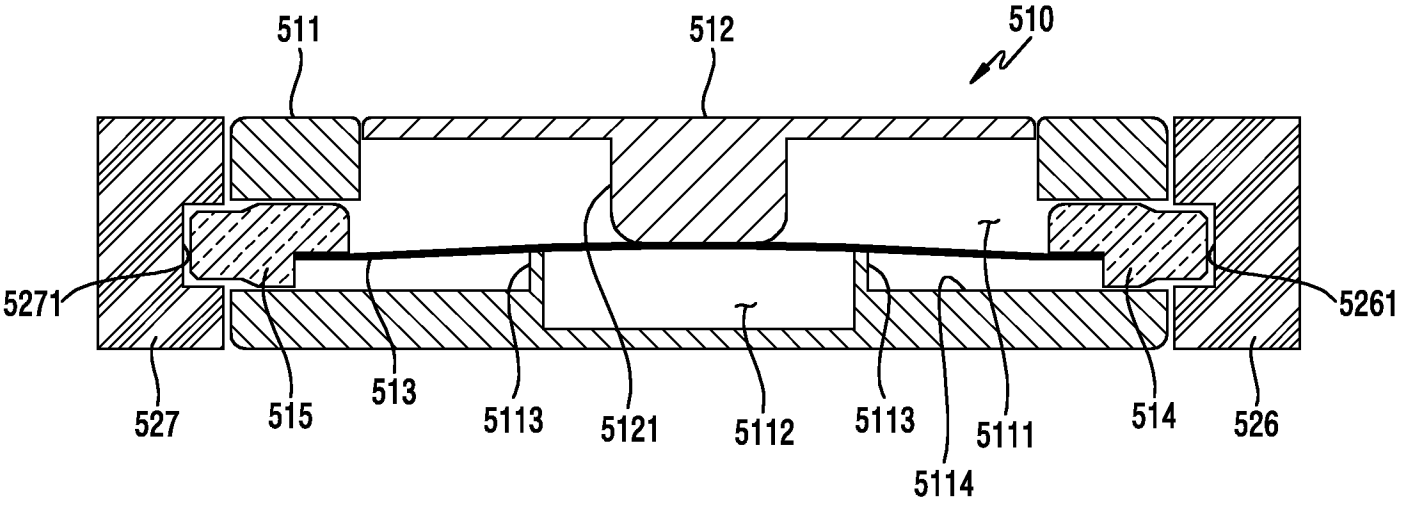
FIG. 5B is a sectional view taken along line A-A' of FIG. 5A according to embodiments of the present disclosure.
Figure 6A:
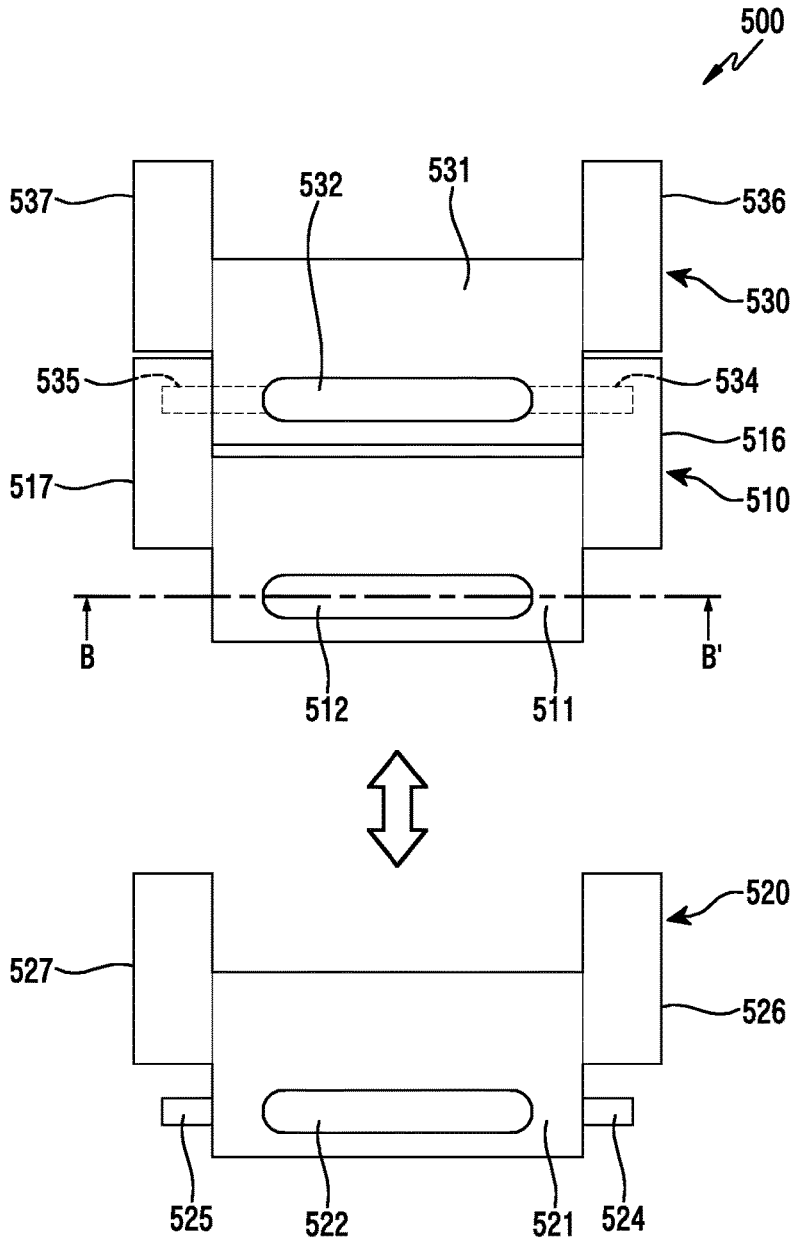
FIG. 6A illustrates when one of the plurality of unit links according to embodiments of the present disclosure has been separated.
Figure 6B:
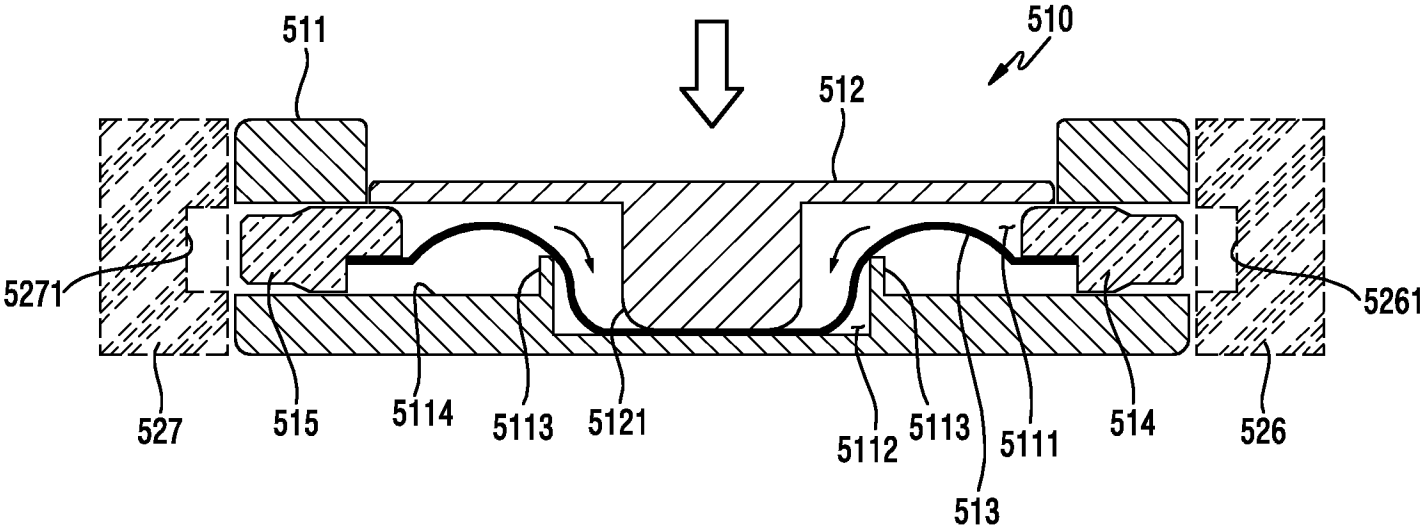
FIG. 6B is a sectional view taken along line B-B' of FIG. 6A according to embodiments of the present disclosure.

FIG. 5A illustrates a plurality of unit links coupled together according to embodiments of the present disclosure. FIG. 5B is a sectional view taken along line A-A' of FIG. 5A according to embodiments of the present disclosure. FIG. 6A illustrates when one of the plurality of unit links according to embodiments of the present disclosure has been separated. FIG. 6B is a sectional view taken along line B-B' of FIG. 6A according to embodiments of the present disclosure.

The unit links 510, 520, and 530 of FIGS. 5A to 6B may be similar to the unit links 321, 322, 323, and 324 of FIG. 3A or the unit link 400 of FIG. 4A, and may include other embodiments of the unit links.

A fastening and separation structure for the three unit links 510, 520, and 530 is illustrated in the drawings. However, this configuration may be applied to all of the plurality of unit links constituting the illustrated strap 500.

Referring to FIGS. 5A and 5B, the strap 500 may have a configuration in which the second and third unit links 520 and 530 are fastened to opposite sides of the first unit link 510. According to one embodiment, the first unit link 510 may be fastened to the second unit link 520 such that a first hinge pin 514 protruding from one side surface of a link body 511 is inserted into a first pin-receiving hole 5261 formed in a first link block 526 of the second unit link 520, and a second hinge pin 515 protruding from an opposite side surface of the link body 511 is inserted into a second pin-receiving hole 5271 formed in a second link block 527 of the second unit link 520. The link body 511 may have a button 512 exposed to the outside and including a rib-fixing protrusion 5121 extending to one region of a button-receiving groove 5111 formed in the link body 511, and a tension rib 513 secured to the first and second hinge pins 514 and 515 at opposite ends thereof may be secured to the rib-fixing protrusion 5121. The tension rib 513 may be installed to be supported by a pair of rib-stopping pieces 5113 protruding beyond the bottom 5114 of the button-receiving space 5111. A protrusion-positioning recess 5112 lower than the bottom 5114 of the button-receiving space 5111 may be formed between the pair of rib-stopping pieces 5113, and may be configured to receive the rib-fixing protrusion 5121 of the button 512 and a part of the tension rib 513 secured to the lower side of the rib-fixing protrusion 5121, thereby increasing the extent to which the tension rib 513 is deformed or bent in a relatively small space. The protrusion-positioning recess 5112 and/or the rib-stopping pieces 5113 may support the tension rib 513 secured to the rib-fixing protrusion 5121 of the button 512 to prevent the button 512 and the tension rib 513 from moving randomly. The tension rib 513 may be formed in an arch shape having a predetermined curvature to closely contact the button 512 and provide tension and movement restriction. This configuration for preventing movement enhances the reliability of the apparatus and alleviates vibration and noise between the unit links by preventing a movement of the button 512 and/or the hinge pins 514 and 515 in the externally visible portion of the apparatus. The tension rib 513 may be maintained in a nearly flat state in the horizontal direction, and the maintaining force enables the first and second hinge pins 514 and 515 to remain protruding from opposite side surfaces of the link body 511.

According to embodiments, a link body 521 of the second unit link 520 may also include an exposed corresponding button 522 and first and second hinge pins 524 and 525 protruding from opposite side surfaces of the link body 521, similarly to the first link body 511 of the first unit link 510. A corresponding button 532 exposed from a link body 531 of the third unit link 530 and first and second hinge pins 534 and 535 protruding from opposite side surfaces of the link body 531 may also be fastened to first and second link blocks 516 and 517 of the first unit link 510 in the same manner. The third unit link 530 may include first and second link blocks 536 and 537 for receiving first and second hinge pins of another unit link.

Referring to FIGS. 6A and 6B, the button 512 may move into the button-receiving groove 5111 in the link body 511, as described above, when the button 512 exposed from the link body 511 of the first unit link 510 is pressed when the first to third unit links 510, 520, and 530 have been fastened together. The rib-fixing protrusion 5121 of the button 512 and the tension rib 513 may be positioned in the protrusion-positioning recess 5112 in the button-receiving groove 5111 by the movement of the button 512. According to one embodiment, the tension rib 513 may be deformed by the pressing of the rib-fixing protrusion 5121 and the support of the rib-stopping pieces 5113 that protrude to surround the protrusion-positioning recess 5112. The entire horizontal length of the tension rib 513 is decreased by the deformation of the tension rib 513, and thus the first and second hinge pins 514 and 515 protruding from the opposite sides of the link body 511 may move into the link body 511. The first unit link 510 may be separated from the second unit link 520 when the button 512 has been pressed.

According to embodiments, when the external force is released from the button 512, the tension rib 513 may be flattened within the button-receiving groove 5111 by the restoring force, and thus the first and second hinge pins 514 and 514 may protrude again from the link body 511 to the outside.

According to embodiments, the third unit link 530 may also be separated from the first unit link 510 by pressing the corresponding button 532 in the same manner. The overall length of the strap 500 may be easily shortened by removing the first unit link 510 and fastening the second and third unit links 520 and 530 together in the above-described manner.

Figure 7:
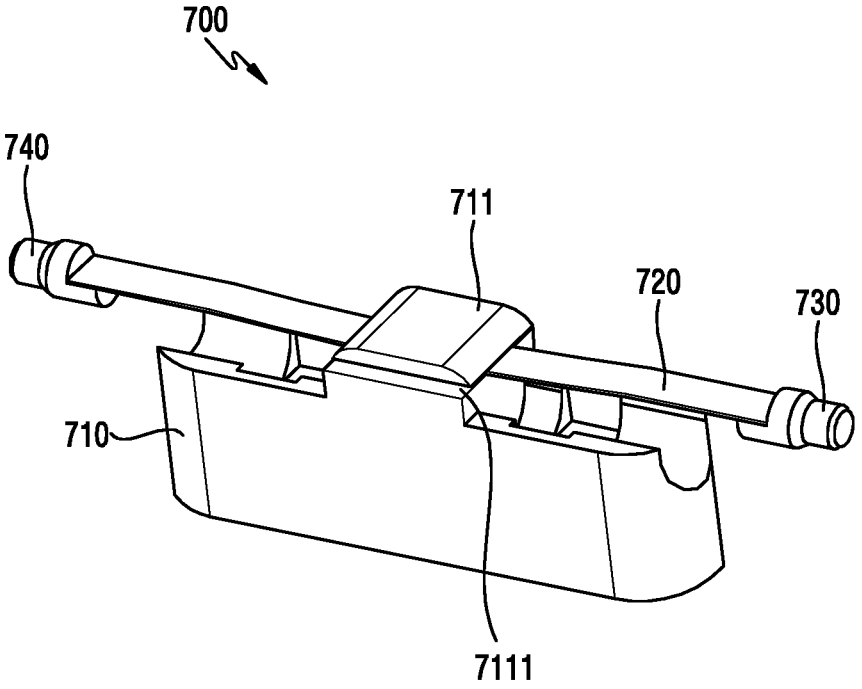
FIG. 7 is a perspective view of a button assembly according to embodiments of the present disclosure.

FIG. 7 is a perspective view of a button assembly according to embodiments of the present disclosure.

Referring to FIG. 7, the button assembly 700 may include a button 710, a rib-fixing protrusion 711 extending from the button 710, a tension rib 720 secured to the rib-fixing protrusion 711, and a pair of hinge pins 730 and 740 secured to the left and right ends of the tension rib 720, respectively. According to one embodiment, the materials of the tension rib 720 and the hinge pins 730 and 740, and the method of fixing the tension rib 720 and the hinge pins 730 and 740 together may be the same as the configuration of FIG. 4B described above.

According to embodiments, the rib-fixing protrusion 711 may include a rib-receiving slot 7111 formed therein from a side surface thereof to the center by a predetermined depth. The rib-receiving slot 7111 may be formed to a predetermined depth from various surfaces of the rib-fixing protrusion. The tension rib 720 may be fixedly inserted into the rib-receiving slot 7111 formed in the rib-fixing protrusion 711, may be press-fitted into the rib-receiving slot 7111, and may be inserted into the rib-receiving slot 7111 and then firmly secured to the rib-fixing protrusion 711 via a fusing, soldering, welding, bonding, or taping process.

Figure 8A:
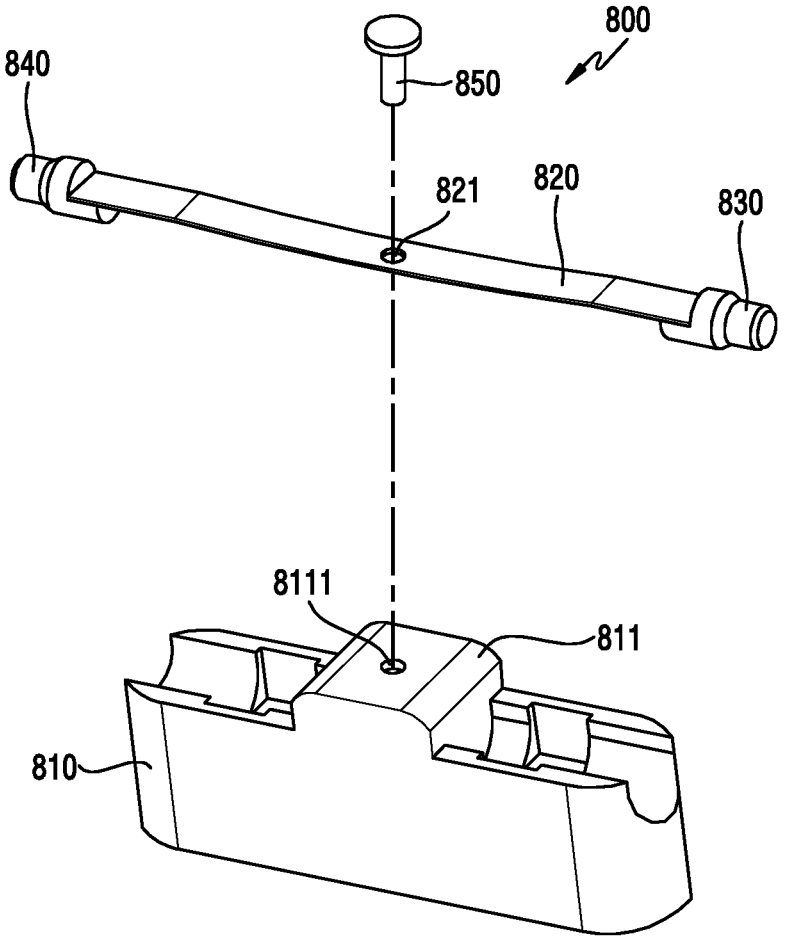
FIGS. 8A, 8B and 8C are perspective views of a button assembly according to embodiments of the present disclosure.
Figure 8B:
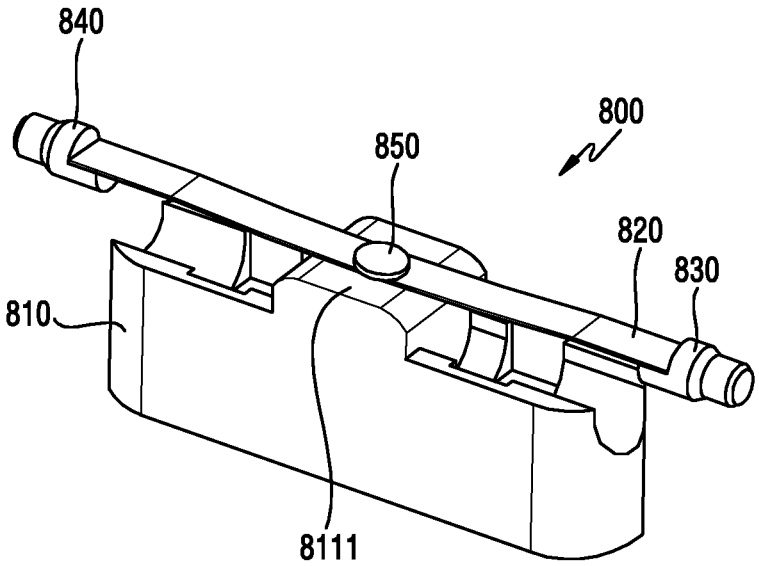
Figure 8C:
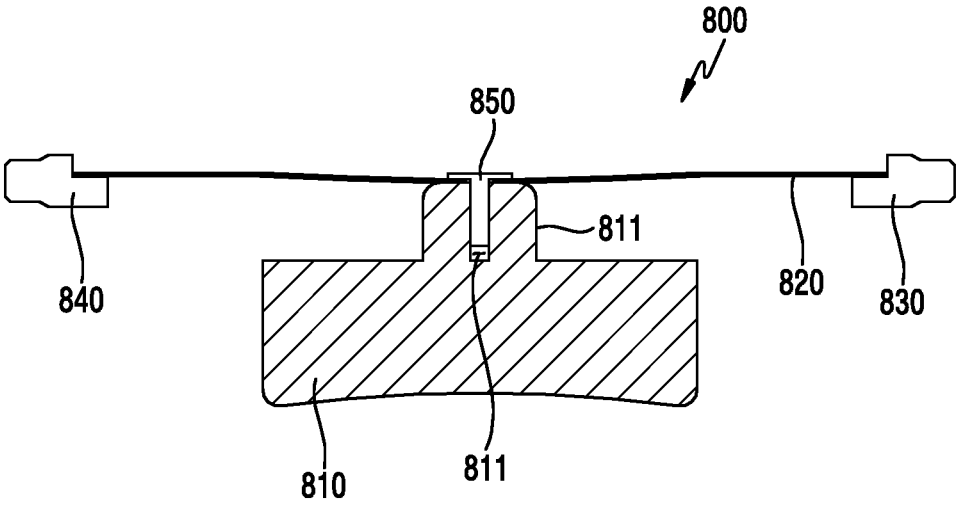

FIGS. 8A, 8B and 8C are perspective views of a button assembly according to embodiments of the present disclosure.

Referring to FIGS. 8A, 8B and 8C, the button assembly 800 may include a button 810, a rib-fixing protrusion 811 extending from the button 810, a tension rib 820 secured to the rib-fixing protrusion 811, and a pair of hinge pins 830 and 840 secured to the left and right ends of the tension rib 820, respectively. According to one embodiment, the materials of the tension rib 820 and the hinge pins 830 and 840, and a method of fixing the tension rib 820 and the hinge pins 830 and 840 together may be the same as the configuration of FIG. 4B described above.

According to embodiments, the tension rib 820 may include a rivet through-hole 821 that is formed through the center of the tension rib 820 having a predetermined length. The rib-fixing protrusion 811 of the button 810 may include a rivet-receiving hole 8111. The tension rib 820 may be secured to the rib-fixing protrusion 811 of the button 810 by fastening a rivet 850 having passed through the rivet through-hole 821 in the tension rib 820 to the rivet-receiving hole 8111 in the rib-fixing protrusion 811. The rivet 850 may be press-fitted into the rivet-receiving hole 8111, or may be fastened to the rivet-receiving hole 8111 using a separate assembly jig, to secure the tension rib 820 to the rib-fixing protrusion 811. Alternatively, the tension rib 820 may be secured to the rib-fixing protrusion 811 by a screw fastened to the rib-fixing protrusion 811 through the tension rib.

Figure 9A:
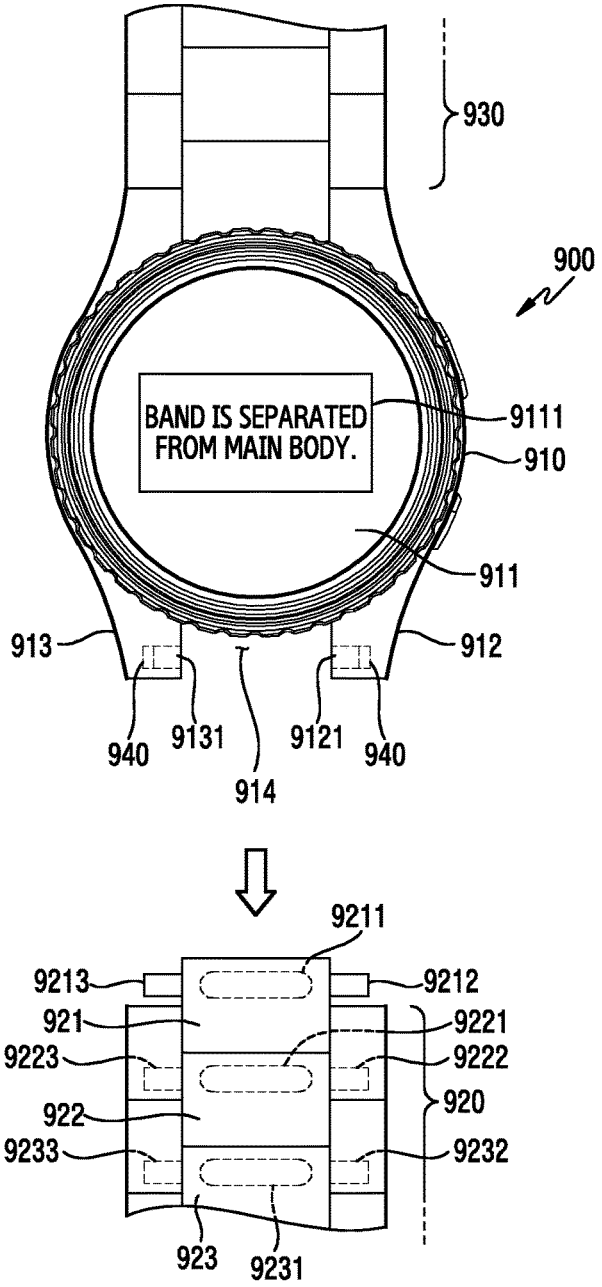
FIG. 9A illustrates when a strap has been separated from a housing according to embodiments of the present disclosure.

FIG. 9A illustrates when a strap has been separated from a housing according to embodiments of the present disclosure.

The electronic device 900 of FIG. 9A may be similar to the electronic device 300 of FIG. 3A, or may include another embodiment of the electronic device.

Referring to FIG. 9A, the electronic device 900 may include a housing 910 including a display 911, and a strap 920 fastened to a pair of strap-fastening parts 912 and 913 formed on one end of the housing 910 and spaced apart from each other by a predetermined distance. According to one embodiment, the housing 910 may include other strap-fastening parts formed on an opposite end thereof, and another strap 930 may be fastened to the corresponding strap-fastening parts.

According to embodiments, the strap 920 may include a plurality of unit links 921, 922, and 923 that may be fastened together in the same manner as those illustrated in FIGS. 3A to 6B described above. The strap 920 may include the first unit link 921 fastened to the pair of strap-fastening parts 912 and 913 formed on the housing 910, the second unit link 922 fastened to the first unit link 921, and the third unit link 923 fastened to the second unit link 922. The first unit link 921 may have hinge pins 9212 and 9213 protruding from opposite side surfaces thereof, and may be connected with the strap-fastening parts 912 and 913 by pressing a corresponding button 9211. The second unit link 922 may be secured to the first unit link 921 by fastening hinge pins 9222 and 9223 protruding from opposite side surfaces of the second unit link 922 to the first unit link 921, and may be separated from the first unit link 921 by moving the hinge pins 9222 and 9223 into the second unit link 9222 by pressing a corresponding button 9221. The third unit link 923 may also be secured to the second unit link 922 by fastening hinge pins 9232 and 9233 protruding from opposite side surfaces of the third unit link 923 to the second unit link 922, and may be separated from the second unit link 922 by moving the hinge pins 9232 and 9233 into the third unit link 923 by pressing a corresponding button 9231.

According to embodiments, a fastening space 914 may be provided between the pair of strap-fastening parts 912 and 913, which are spaced apart from each other by a predetermined distance, and at least a part of the first unit link 921 may be received in the fastening space 914. The first strap-fastening part 912 may have a first pin-receiving recess 9121 formed therein, and the first hinge pin 9212 of the first unit link 921 may be fixedly inserted into the first pin-receiving recess 9121. The second strap-fastening part 913 may have a second pin-receiving recess 9131 formed therein, and the second hinge pin 9213 of the first unit link 921 may be fixedly inserted into the second pin-receiving recess 9131.

According to embodiments, at least one strap detection sensor 940 may be provided in the first pin-receiving recess 9121 and/or the second pin-receiving recess 9131. When the hinge pins 9212 and 9213 of the first unit link 921 are inserted into the pin-receiving recesses 9121 and 9131, respectively, the strap detection sensors 940 may sense interference with end portions of the respective hinge pins 9212 and 9213, or may sense the end portions of the hinge pins 9212 and 9213, to thereby detect fastening of the strap 920. The strap detection sensors 940 may be electrically connected with a processor of the electronic device 900. When the strap 920 is removed from the strap-fastening parts 912 and 913 or when the hinge pins 9212 and 9213 are incompletely inserted into the pin-receiving recesses 9121 and 9232, the strap detection sensors 940 may detect such a state and may provide state information to the processor. The processor may control an output unit of the electronic device 900 based on the state information provided by the strap detection sensors 940 to provide notification information to the user of the electronic device.

According to embodiments, the processor may receive, from the strap detection sensors 940, state information indicating that the strap 920 has been separated from the housing 910, and the processor may control the display 911 based on the corresponding state information to visually provide notification information 9111 to the user. Alternatively, the processor may control an audio module to acoustically provide the notification information to the user, or may control a motor, such as a vibrator, to provide the notification information to the user in a tactile manner.

According to embodiments, the strap detection sensors 940 may include a tact switch that is turned on/off by the pressing force of the hinge pins 9212 and 9213, an optical sensor that detects the presence or absence of the hinge pins, and an electrical sensor that detects whether electricity flows by means of the hinge pins, which are made of metal.

Figure 9B:
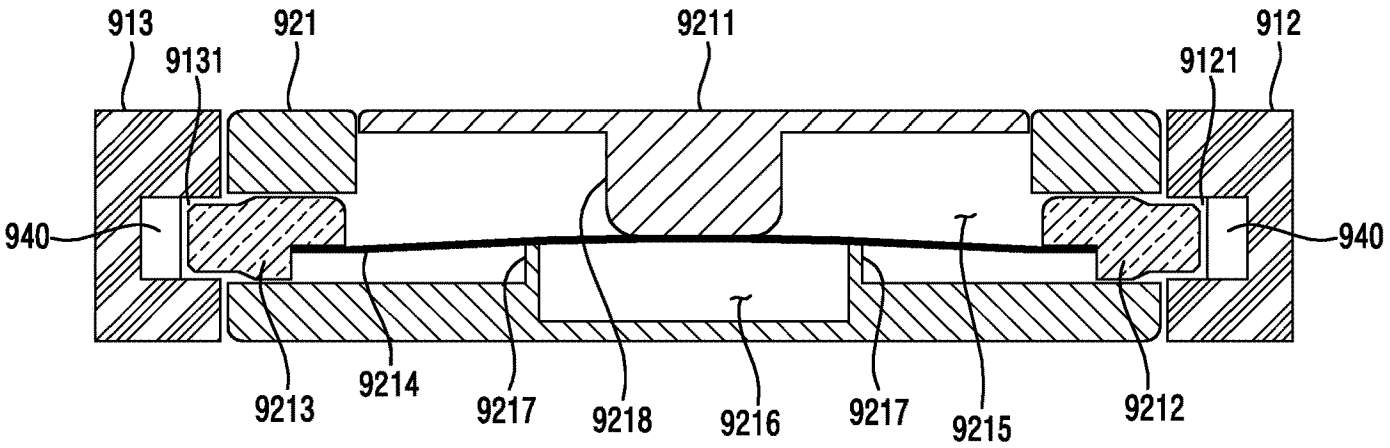
FIGS. 9B and 9C are sectional views of major components, where
Figure 9C:
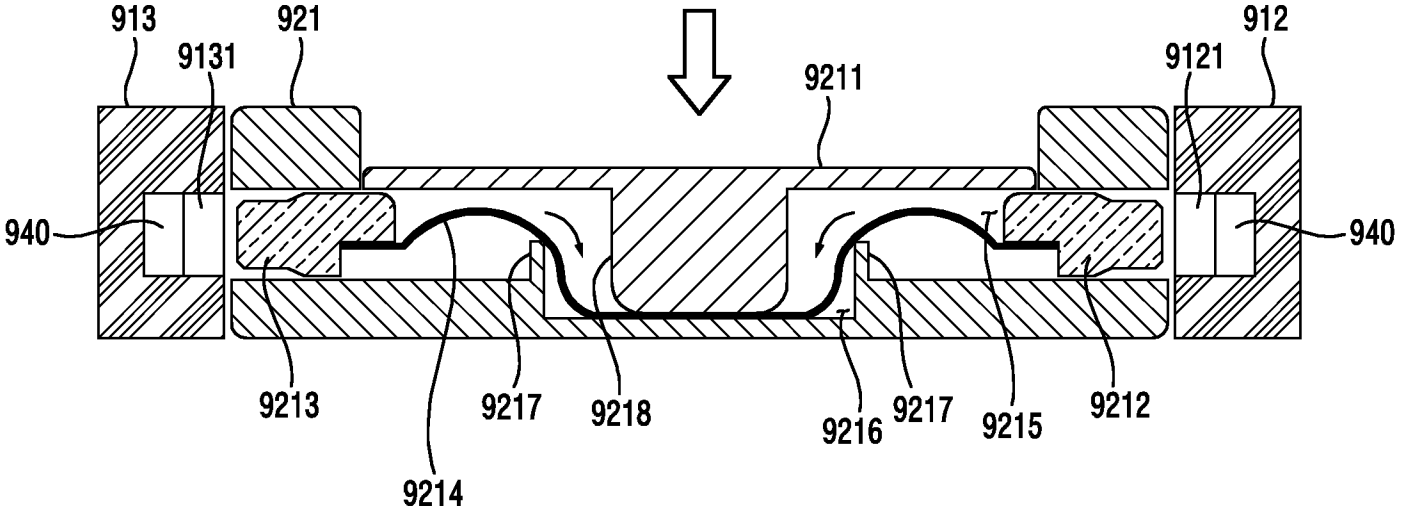

FIGS. 9B and 9C are sectional views of major components, and illustrate when the strap according to embodiments of the present disclosure has been coupled to and separated from the housing.

Referring to FIGS. 9A, 9B and 9C, the strap 920 may be secured to the housing 910 such that the pair of hinge pins 9212 and 9213 protruding from opposite sides of the first unit link 921 is inserted into the pin-receiving recesses 9121 and 9131 formed in the pair of strap-fastening parts 912 and 913 of the housing 910, respectively. According to one embodiment, the first unit link 921 may be fastened to the housing 910 such that the first hinge pin 9212 protruding from one side surface of the first unit link 921 is inserted into the first pin-receiving recess 9121 in the first strap-fastening part 912, and the second hinge pin 9213 protruding from the opposite side surface of the first unit link 921 is inserted into the second pin-receiving recess 9131 in the second strap-fastening part 913.

According to embodiments, the first unit link 921 may include the button 9211 exposed from the outer surface thereof and including a rib-fixing protrusion 9218 extending to one region of a button-receiving groove 9215 formed in the first unit link 921, and a tension rib 9214 secured to the first and second hinge pins 9212 and 9213 at opposite ends thereof may be secured to the rib-fixing protrusion 9218. The tension rib 9214 may be installed to be supported by a pair of rib-stopping pieces 9217 protruding beyond the bottom of the button-receiving space 9215.

A protrusion-positioning recess 9216 lower than the bottom of the button-receiving space 9215 may be formed between the pair of rib-stopping pieces 9217, and may be configured to receive the rib-fixing protrusion 9218 of the button 9211 and a part of the tension rib 9214 secured to the lower side of the rib-fixing protrusion 9218, thereby increasing the extent to which the tension rib 9214 is deformed or bent in a relatively small space. The tension rib 9214 may be maintained in a nearly flat state in the horizontal direction, and the maintaining force enables the first and second hinge pins 9212 and 9213 to remain protruding from opposite side surfaces of the first unit link 921.

According to embodiments, the hinge pins 9212 and 9213 may be disposed to be sensed by the strap detection sensors 940 disposed in the pin-receiving recesses 9121 and 9131 in the strap-fastening parts 912 and 913 of the housing 910, and the state information may be provided to the processor of the electronic device through the strap detection sensors 940.

According to embodiments, the button 9211 exposed from the first unit link 921 may move into the button-receiving groove 9215 when the button 9211 is pressed while the first unit link 921 has been fastened to the strap-fastening parts 912 and 913 of the housing 910. The rib-fixing protrusion 9218 of the button 9211 and the tension rib 9214 may be positioned in the protrusion-positioning recess 9216 in the button-receiving groove 9215 by the movement of the button 9211. The tension rib 9214 may be deformed by the pressing of the rib-fixing protrusion 9218 and the support of the rib-stopping pieces 9217 that protrude to surround the protrusion-positioning recess 9216. The entire horizontal length of the tension rib 9214 is decreased by the deformation of the tension rib 9214, and thus the first and second hinge pins 9212 and 9213 protruding from opposite sides of the first unit link 921 may move into the first unit link 921. The first unit link 921 may be separated from the strap-fastening parts 912 and 913 of the housing 910 when the button 9211 has been pressed.

According to embodiments, when the strap 920 is removed from the housing 910, the strap detection sensor 940 disposed in the strap-fastening parts 912 and 913 may detect this state, and the sensed state information may be provided to the processor of the electronic device 900. When the processor determines that the strap 920 has been separated from the housing based on the received state information, the processor may output information according to a relevant function through the electronic device 900.

The electronic device 900 may be functionally connected with another electronic device, such as a smart phone, through wireless communication including Bluetooth® or radio frequency (RF) communication. In this case, the processor may sense the separation of the strap 920 from the housing 910 and may output information according to a relevant function through the other electronic device, such as by visual output through a display of the other electronic device, acoustical output through a speaker device of the other electronic device, or by a motor of the other electronic device in a tactile manner.

Figure 10A:
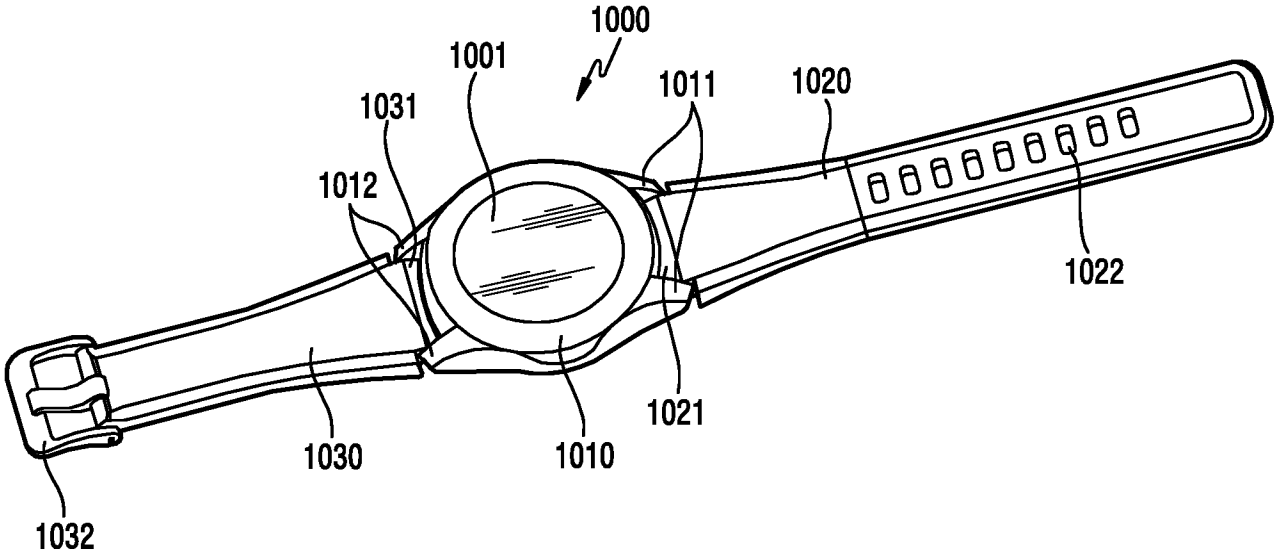
FIGS. 10A and 10B are front and rear perspective views of a wearable electronic device according to embodiments of the present disclosure.
Figure 10B:
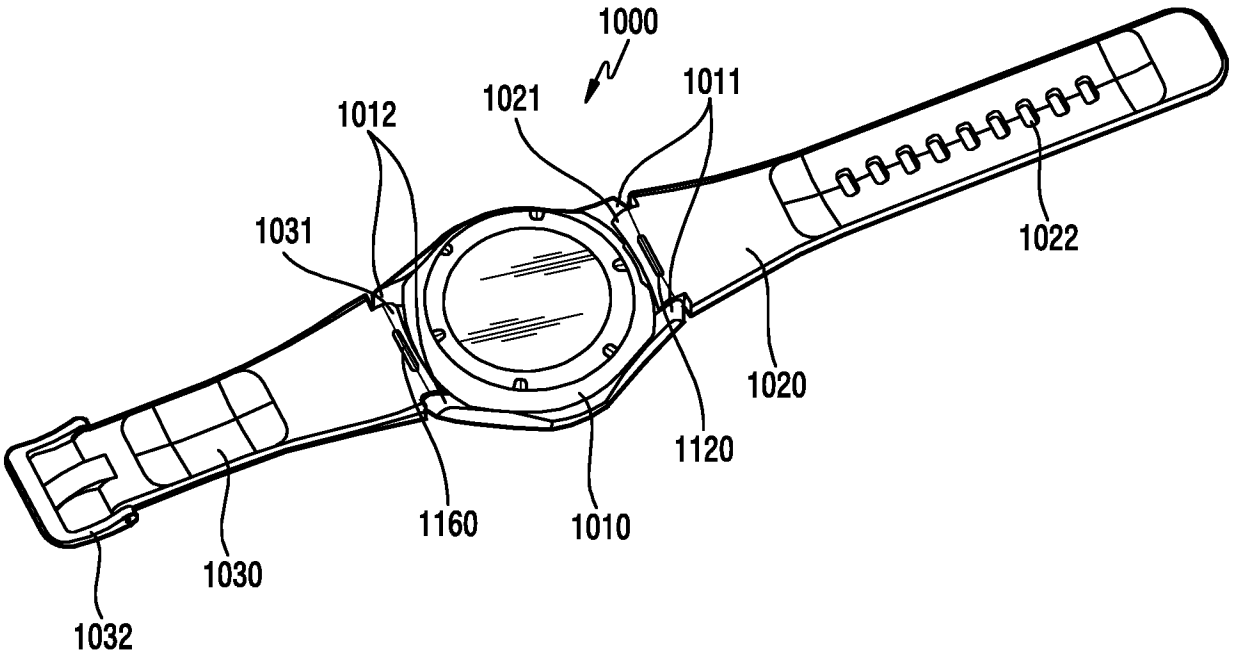
Figure 10C:
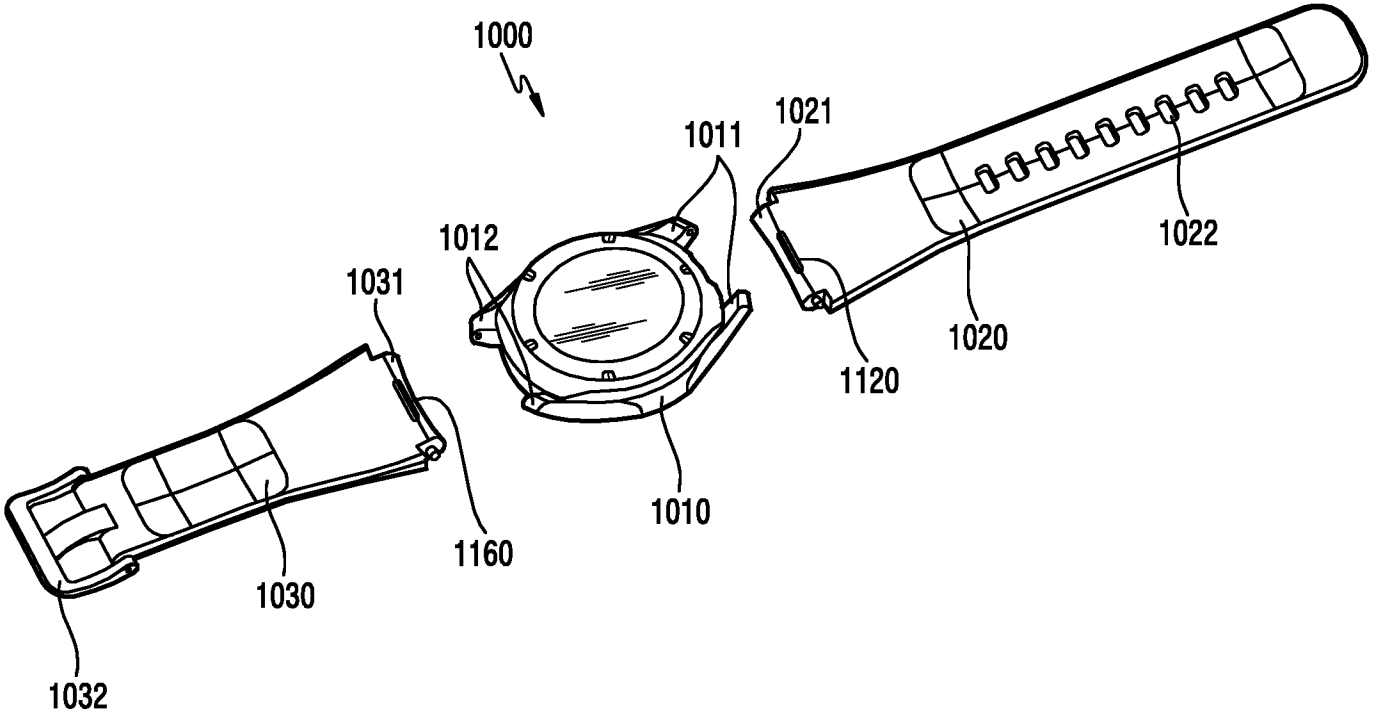
FIG. 10C illustrates when straps have been separated from the housing of the wearable electronic device according to embodiments of the present disclosure.

FIGS. 10A and 10B are front and rear perspective views of a wearable electronic device according to embodiments of the present disclosure. FIG. 10C illustrates when straps have been separated from the housing of the wearable electronic device according to embodiments of the present disclosure.

The electronic device 1000 of FIGS. 10A, 10B and 10C may be similar to the electronic device 300 of FIG. 3A or the electronic device 900 of FIG. 9A, or may include other embodiments of the electronic device.

Referring to FIGS. 10A, 10B and 10C, the electronic device 1000 may include a housing 1010 having a display 1001 and a pair of straps 1020 and 1030 secured to fastening parts 1011 and 1012 formed on opposite ends of the housing 1010. According to one embodiment, the straps 1020 and 1030 may be formed of rubber, leather, urethane, or silicone, and may include the first strap 1020 including a first fixing part 1021 fastened to the first fastening parts 1011 of the housing 1010, and the second strap 1030 including a second fixing part 1031 fastened to the second fastening parts 1012 of the housing 1010. The second strap 1030 may include a buckle member 1032 disposed on an end portion thereof, and the first strap 1020 may include a plurality of buckle-fixing recesses 1022 formed therein to enable the first strap 1020 and the second strap 1030 to be connected by means of the buckle member 1032. The fastening length of the straps 1020 and 1030 may be adjusted by securing the buckle member 1032 to one of the plurality of buckle-fixing recesses 1022.

Figure 11A:
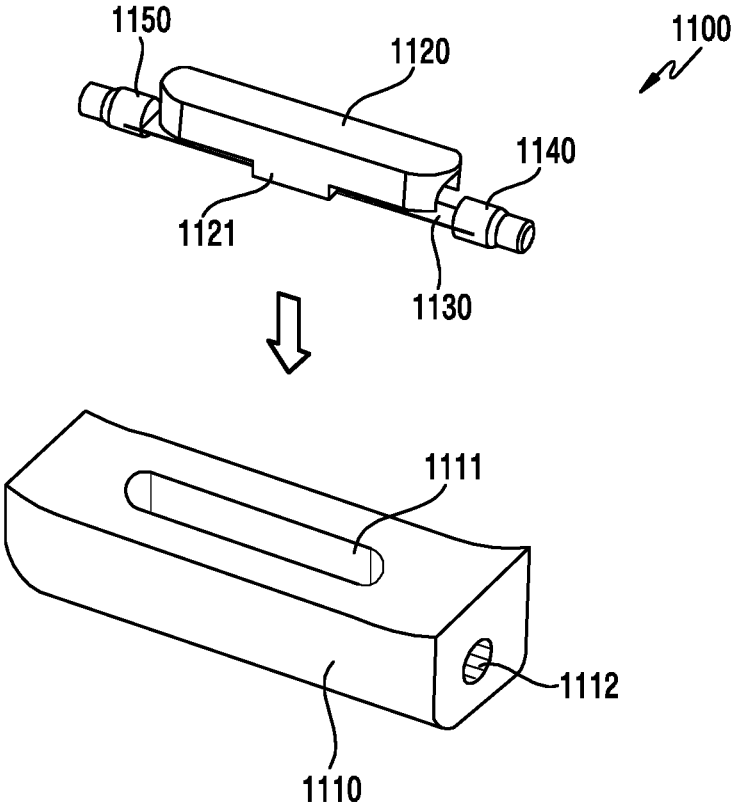
FIG. 11A is an exploded perspective view of a button assembly according to embodiments of the present disclosure.

According to embodiments, buttons 1120 and 1160 may be respectively exposed from the rear surfaces of the first and second fixing parts 1021 and 1031 of the first and second straps 1020 and 1030 that are secured to the fastening parts 1011 and 1012 of the housing 1010, and may operate as elements of button assemblies, such as a button assembly 1100 of FIG. 11A, that are insert-molded or double-injection molded into the first and second straps 1020 and 1030, respectively. A description of the button assemblies will be given below. The button assemblies may have the same configuration as the button assemblies illustrated in FIGS. 4A to 9B described above. The straps 1020 and 1030 may be easily separated from the housing 1010 merely by pressing the corresponding buttons 1120 and 1160 exposed from the rear surfaces of the respective straps.

Figure 11B:
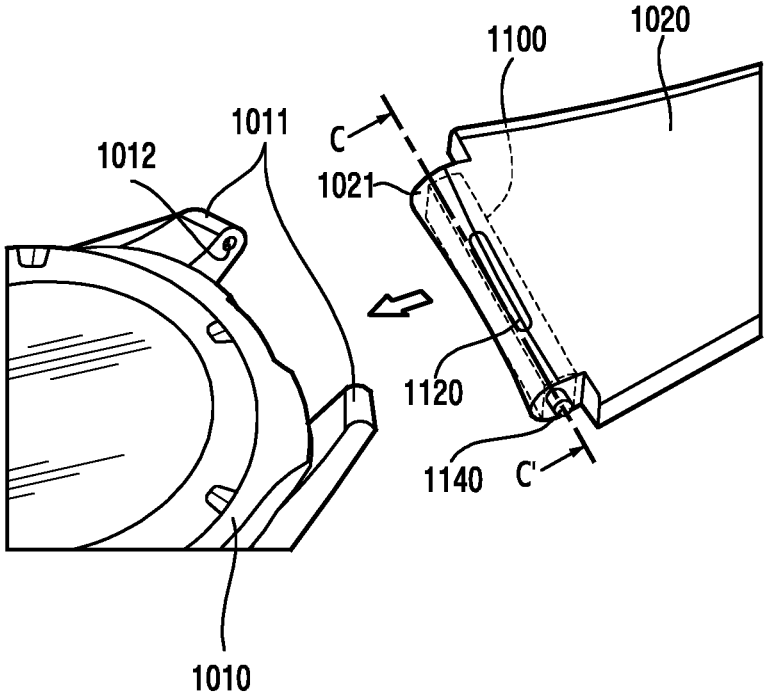
FIG. 11B illustrates when the button assembly according to embodiments of the present disclosure has been embedded in a strap.
Figure 11C:
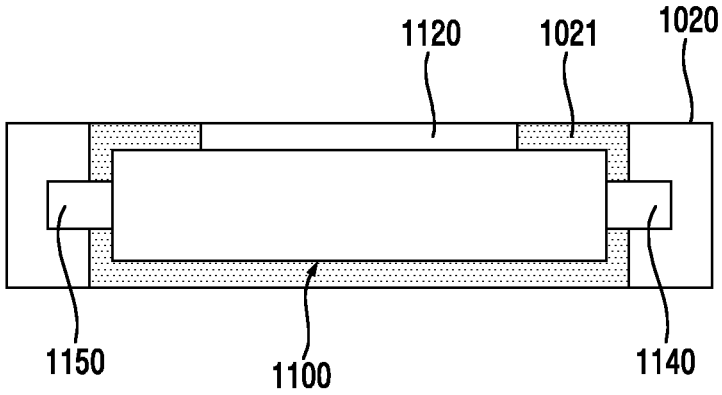
FIG. 11C is a sectional view taken along line C-C' of FIG. 11B according to embodiments of the present disclosure.

FIG. 11A is an exploded perspective view of a button assembly according to embodiments of the present disclosure. FIG. 11B illustrates when the button assembly according to embodiments of the present disclosure has been embedded in a strap. FIG. 11C is a sectional view taken along line C-C' of FIG. 11B according to embodiments of the present disclosure.

Referring to FIGS. 11A, 11B and 11C, the button assembly 1100 may include a button-receiving body 1110 having a button-receiving groove 1111 and a hinge-pin-receiving hole 1112 formed therein to communicate with each other, and a button 1120 received in the button-receiving groove 1111 in the button-receiving body 1110 and including a tension rib 1130 secured to a rib-fixing protrusion 1121 and having hinge pins 1140 and 1150 secured to opposite ends thereof. According to one embodiment, the shape of the button 1120, the tension rib 1130, and the pair of hinge pins 1140 and 1150 and the coupling relationship therebetween are the same as those described above, and detailed descriptions thereof will thus be omitted.

According to embodiments, the completely assembled button assembly 1100, except the button 1120 and the pair of hinge pins 1140 and 1150, may be embedded in the fixing part 1021 of the strap 1020. The button assembly 1100 may be embedded in the strap 1020 through a double-injection molding or insert molding process when the strap 1020 is formed of a synthetic resin, rubber, silicone, or urethane.

Referring to FIGS. 11B and 11C, when the button assembly 1100 is embedded in the fixing part 1021 of the strap 1020, the button 1120 may be exposed from the strap 1020 to the outside, and the pair of hinge pins 1140 and 1150 may protrude from opposite side surfaces of the fixing part 1021. According to one embodiment, the hinge pins 1140 and 1150 may move into the fixing part 1021 when the button 1120 is pressed in order to secure the strap 1020 to the housing 1010. In order to secure the strap 1020 to the housing 1010, the fixing part 1021 of the strap 1020 may be located between the fastening parts 1011 of the housing 1010 when the button 1120 has been pressed, and then the external force applied to the button 1120 may be removed. When the external force is removed from the button 1120, the hinge pins 1140 and 1150 may protrude again through the opposite side surfaces of the fixing part 1021 and may be inserted into the pin-receiving recesses 1012 formed in the fastening parts 1011 of the housing 1010, and thus the strap 1020 may be secured to the housing 1010. The strap detection sensors 940 illustrated in FIGS. 9A and 9B described above may be additionally disposed in the pin-receiving recesses 1012.

According to embodiments, the straps can be easily separated from the housing merely through a simple button operation. In addition, it is possible for an electronic device user, rather than a specialized operator, to adjust the length of the straps in a simple manner by adding or removing a unit link merely by operating the buttons and without using a separate working tool.

A wearable electronic device includes a housing, and a strap fastened to at least a part of the housing so as to be detachable, wherein the strap includes a plurality of unit links, a button exposed from at least one of the plurality of unit links so as to be operable, a tension rib secured to an end portion of the button in the internal space of the unit link and having opposite ends, the positions of which are changed by pressing the button, and a pair of hinge pins secured to the opposite ends of the tension rib, respectively, and disposed to at least partially protrude from the left and right sides of the unit link, wherein the plurality of unit links are fastened to or separated from each other such that the hinge pins moving, by means of a press of the button, are inserted into or extracted from pin-receiving recesses formed in an adjacent unit link.

The plurality of unit links may be formed of metal, ceramic, or a synthetic resin.

The tension rib may be secured, at the central region thereof, to a rib-fixing protrusion protruding from the end portion of the button.

The tension rib may be secured to a surface of the rib-fixing protrusion through a soldering, welding, bonding, fusing, or taping process.

The tension rib may be fixedly inserted into a slot formed in the rib-fixing protrusion to a predetermined depth.

The tension rib may be secured to the rib-fixing protrusion by a rivet or a screw that passes through a through-hole formed in the tension rib and is then fastened to a fixing hole formed in the rib-fixing protrusion.

A protrusion-positioning recess may be formed in the internal space of the unit link so as to be lower than an inner surface of the unit link to receive the pressed rib-fixing protrusion and a part of the tension rib.

A rib-stopping piece may be formed around the protrusion-positioning recess to a predetermined height from the inner surface in order to induce deformation of the tension rib by supporting the tension rib.

The tension rib may be formed of aluminum, steel, SUS, or a synthetic resin, and may be formed in a plate spring type or in a string type.

The pair of hinge pins may be secured to opposite end portions of the tension rib through a soldering, welding, bonding, or taping process.

The unit link may include a link body that receives the button, the tension rib, and the pair of hinge pins in the internal space thereof, and a pair of link blocks protruding from opposite ends of the link body, respectively.

The plurality of unit links may be connected together such that the hinge pins protruding from the opposite side surfaces of the link body of the unit link are inserted into pin-receiving recesses formed at corresponding positions of link blocks disposed in the adjacent unit link.

The pair of hinge pins may move into the internal space by means of the tension rib, which is deformed by pressing the button to have a reduced length.

Among the plurality of unit links, a unit link coupled to the housing may be secured such that a pair of hinge pins protruding from opposite side surfaces of the unit link is inserted into pin-receiving recesses formed in strap-fastening parts of the housing.

The electronic device may further include strap detection sensors disposed in the pin-receiving recesses to sense whether the hinge pins are present in the pin-receiving recesses.

The electronic device may further include a display for visually outputting, to a user, information about whether the hinge pins are present in the pin-receiving recesses, the information being sensed by the strap detection sensors.

The wearable electronic device may include a watch-type electronic device, the housing of which is held on a user's wrist by the strap.

A wearable electronic device includes a housing, a strap fastened to at least a part of the housing so as to be detachable, and a button assembly embedded in the strap and detachably connecting the strap to the housing, wherein the button assembly includes: a button-receiving body having a space therein, a button exposed from at least a part of the button-receiving body so as to be operable, a tension rib secured to an end portion of the button in the space inside the button-receiving body and having opposite ends, the positions of which are changed by pressing the button, and a pair of hinge pins secured to the opposite ends of the tension rib, respectively, and disposed to at least partially protrude from the left and right sides of the button-receiving body, wherein the strap is fastened to or separated from the housing such that the hinge pins, moving by means of a press of the button, are inserted into or extracted from pin-receiving recesses formed in the housing.

The strap may be formed of at least one of rubber, urethane, silicone, and a synthetic resin, and the button assembly may be embedded in the strap by insert molding such that the button and the pair of hinge pins are exposed from the strap to the outside.

Embodiments of the present disclosure disclosed in the specification and the drawings are only particular examples disclosed in order to easily describe the technical matters of the present disclosure and assist with comprehension of the present disclosure, and do not limit the scope of the present disclosure. Therefore, in addition to the embodiments disclosed herein, the scope of the embodiments of the present disclosure should be construed to include all modifications or modified forms drawn based on the technical aspects of the embodiments of the present disclosure.

While the present disclosure has been described with reference to various embodiments, various changes may be made without departing from the spirit and the scope of the present disclosure, which is defined, not by the detailed description and embodiments, but by the appended claims and their equivalents.

What is claimed is:

1. A wearable electronic device comprising:

a housing; and a strap detachably fastened to at least a part of the housing, wherein the strap comprises a plurality of unit links, wherein each of the plurality of unit links comprises:

a button that is exposed from a unit link and is operable to the unit link;

a tension rib secured to an end portion of the button in an internal space of the unit link and having opposite ends, the positions of the opposite ends being changed by pressing on the button; and a pair of hinge pins secured to each of the opposite ends of the tension rib, and disposed to at least partially protrude from left and right sides of the unit links, and wherein the plurality of unit links are fastened to or separated from each other, such that hinge pins of a unit link, moving by the pressing on the button, are inserted into or extracted from pin-receiving recesses formed in an adjacent unit link.

2. The wearable electronic device of claim 1, wherein the plurality of unit links are formed of metal, ceramic, or a synthetic resin.

3. The wearable electronic device of claim 1, wherein the tension rib is secured, at a central region thereof, to a rib-fixing protrusion protruding from the end portion of the button.

4. The wearable electronic device of claim 3, wherein the tension rib is secured to a surface of the rib-fixing protrusion through a soldering, welding, bonding, fusing, or taping process.

5. The wearable electronic device of claim 3, wherein the tension rib is fixedly inserted into a slot formed in the rib-fixing protrusion to a predetermined depth.

6. The wearable electronic device of claim 3, wherein the tension rib is secured to the rib-fixing protrusion by a rivet or a screw that passes through a through-hole formed in the tension rib and is then fastened to a fixing hole formed in the rib-fixing protrusion.

7. The wearable electronic device of claim 3, wherein a protrusion-positioning recess is formed in the internal space of the unit link at a lower depth than a depth of an inner surface of the unit link, to receive the pressed rib-fixing protrusion and a part of the tension rib.

8. The wearable electronic device of claim 7, wherein a rib-stopping piece is formed around the protrusion-positioning recess to a predetermined height from the inner surface and induces deformation of the tension rib by supporting the tension rib.

9. The wearable electronic device of claim 1, wherein the tension rib is formed of aluminum, stainless steel, or a synthetic resin.

10. The wearable electronic device of claim 1, wherein the tension rib is formed in a plate spring type or in a string type.

11. The wearable electronic device of claim 1, wherein the pair of hinge pins is secured to opposite end portions of the tension rib through a soldering, welding, bonding, or taping process.

12. The wearable electronic device of claim 1, wherein each of the plurality of unit links further comprises:

a link body that receives the button, the tension rib, and the pair of hinge pins in the internal space of the unit link; and a link block protruding from each of opposite ends of the link body.

13. The wearable electronic device of claim 12, wherein the plurality of unit links are connected together such that a pair of hinge pins protruding from opposite side surfaces of a link body of a unit link is inserted into pin-receiving recesses formed at corresponding positions of link blocks disposed in an adjacent unit link.

14. The wearable electronic device of claim 1, wherein each of the hinge pins moves into the internal space by means of the tension rib, which is deformed to have a reduced length by the pressing on the button.

15. The wearable electronic device of claim 1, wherein among the plurality of unit links, a unit link coupled to the housing is secured such that a pair of hinge pins protruding from opposite side surfaces of the unit link coupled to the housing is inserted into pin-receiving recesses formed in strap-fastening parts of the housing.

16. The wearable electronic device of claim 15, wherein the electronic device further comprises strap detection sensors disposed in the pin-receiving recesses and sensing whether the hinge pins are present in the pin-receiving recesses.

17. The wearable electronic device of claim 15, wherein the electronic device further comprises a display that visually outputs, to a user, information about whether the hinge pins are inserted in the pin-receiving recesses, the information being sensed by the strap detection sensors.

18. The wearable electronic device of claim 1, wherein the wearable electronic device comprises a watch-type electronic device having a housing that is held on a user's wrist using the strap.

19. A wearable electronic device comprising:

a housing;

a strap detachably fastened to at least a part of the housing, wherein the strap comprises a plurality of unit links, wherein each of the plurality of unit links comprises: a button assembly embedded in the strap and detachably connecting the strap to the housing, wherein the button assembly comprises:

a button-receiving body including an internal space;

a button that is exposed from at least a part of the button-receiving body and is operable to the at least a part of the button-receiving body;

a tension rib secured to an end portion of the button in the internal space inside the button-receiving body and including opposite ends having positions that are changed by pressing on the button; and a pair of hinge pins secured to each of the opposite ends of the tension rib, and disposed to at least partially protrude from left and right sides of the button-receiving body, wherein the strap is fastened to or separated from the housing such that the pair of hinge pins, moving by the pressing on the button, is inserted into or extracted from pin-receiving recesses formed in the housing.

20. The wearable electronic device of claim 19, wherein the electronic device further comprises strap detection sensors disposed in the pin-receiving recesses and sensing whether the hinge pins are present in the pin-receiving recesses.

* * * * *